US006516756B1

(12) United States Patent
Kato et al.

(10) Patent No.: US 6,516,756 B1
(45) Date of Patent: Feb. 11, 2003

(54) FUEL INJECTION SYSTEM FOR MARINE ENGINE

(75) Inventors: Masahiko Kato, Shizuoka (JP); Hiroaki Takase, Shizuoka (JP)

(73) Assignee: Sanshin Kogyo Kabushiki Kaisha (JP)

( * ) Notice: Subject to any disclaimer, the term of this patent is extended or adjusted under 35 U.S.C. 154(b) by 0 days.

(21) Appl. No.: 09/591,458

(22) Filed: Jun. 9, 2000

(30) Foreign Application Priority Data

Jun. 9, 1999 (JP) ..... 11-162559
Jun. 11, 1999 (JP) ..... 11-165708
Jun. 21, 1999 (JP) ..... 11-173957

(51) Int. Cl.[7] ..... F02B 33/04
(52) U.S. Cl. ..... 123/73 AD; 123/196 W
(58) Field of Search ..... 123/73 AD, 196 R, 123/196 W

(56) References Cited

U.S. PATENT DOCUMENTS 4,142,486 A 3/1979 Schreier
4,403,578 A 9/1983 Iwai et al.
4,480,602 A 11/1984 Kobayashi et al.
4,539,949 A 9/1985 Walsworth
4,594,970 A 6/1986 Baars et al.
4,700,671 A 10/1987 Matsushita
4,708,674 A 11/1987 Matsumoto
5,136,990 A 8/1992 Motoyama et al.
5,235,944 A 8/1993 Adachi
5,287,833 A 2/1994 Yashiro
5,297,511 A 3/1994 Suzuki
5,355,851 A 10/1994 Kamiya
5,370,089 A 12/1994 Harada
5,390,635 A 2/1995 Kidera et al.
5,511,524 A 4/1996 Kidera et al.
5,537,959 A 7/1996 Ito
5,594,970 A 1/1997 Benge
5,630,383 A 5/1997 Kidera et al.
5,701,872 A 12/1997 Kaku et al.
5,709,186 A 1/1998 Taue
5,732,672 A 3/1998 Nakase
5,829,401 A 11/1998 Masuda
5,941,745 A * 8/1999 Kanno ..... 123/73 AD
5,951,342 A 9/1999 Ozawa et al.
5,954,555 A 9/1999 Ozawa et al.
5,970,942 A * 10/1999 Koeberlein et al. .... 123/93 AD

* cited by examiner

*Primary Examiner*—Noah P. Kamen
(74) *Attorney, Agent, or Firm*—Knobbe, Martens, Olson & Bear, LLP

(57) ABSTRACT

A fuel injection system for a marine engine includes an improved construction that, by the introduction of lubricant into the fuel, inhibits components of the system from rusting in the event that water, particularly salt water, is mixed with the fuel. The engine includes a lubricant delivery system to deliver lubricant to at least one portion of the engine that needs lubrication. A premix lubricant pump is provided for supplying lubricant with the fuel injection device from the lubricant delivery system so as to mix the part of the lubricant to the fuel. An ECU controls an amount of the part of the lubricant so as to be in a proper and extremely small range.

67 Claims, 12 Drawing Sheets

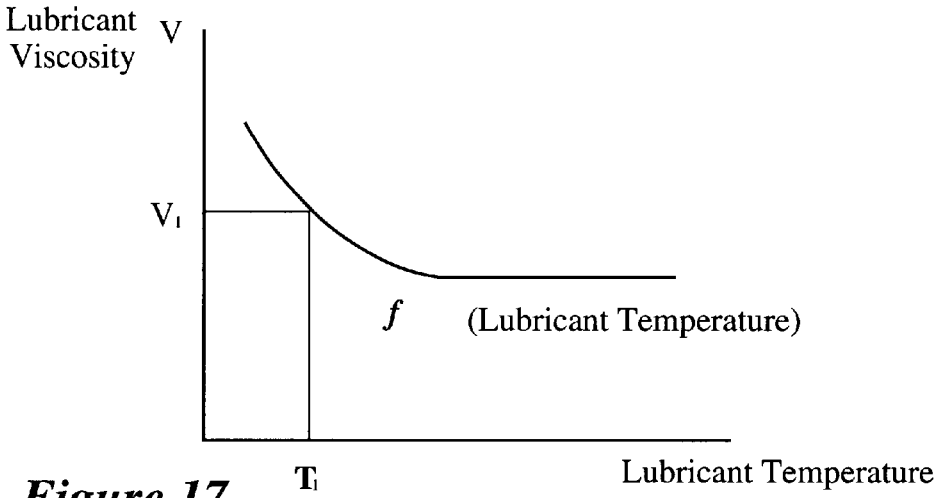
*Figure 17*
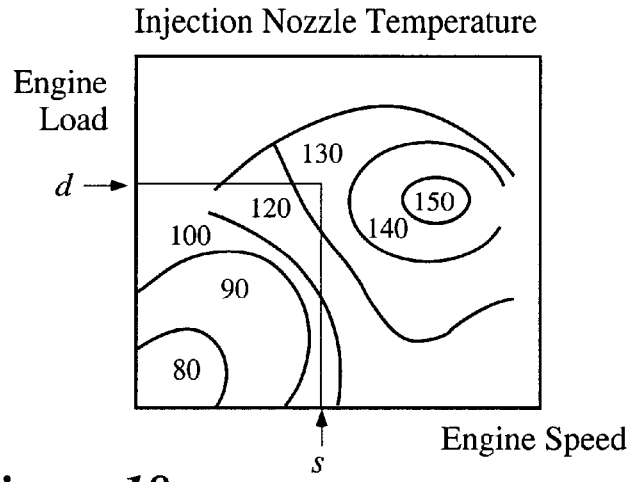
*Figure 18*
Fundamental PreMix Lubricant Amount
Engine Load
| | | | | | | |
|---|---|---|---|---|---|---|
| 8 | 8 | 8 | 8 | 8 | 8 | 8 |
| 8 | 8 | 8 | 8 | 9 | 9 | 8 |
| 8 | 7 | 7 | 9 | 10 | 10 | 9 |
| 7 | 6 | 7 | 8 | 9 | 9 | 8 |
| 5 | 5 | 5 | 7 | 8 | 8 | 7 |
| 0 | 5 | 5 | 7 | 7 | 7 | 7 |
d
s
Engine Speed
*Figure 19*

FUEL INJECTION SYSTEM FOR MARINE ENGINE

PRIORITY INFORMATION

This application is based on and claims priority to Japanese Patent Applications No. 11-162559, filed Jun. 9, 1999, No. 11-165708, filed Jun. 11, 1999 and No. 11-173957, filed Jun. 21, 1999, the entire contents of which are hereby expressly incorporated by reference.

BACKGROUND OF THE INVENTION

1. Field of the Invention

This invention relates to a fuel injection system for a marine engine, and more particularly to an improved fuel injection system with corrosion protection.

2. Description of Related Art

In all fields of engine design, there is an increasing emphasis on obtaining more effective emission control, better fuel economy and, at the same time, continuing to increase power output. This trend has resulted in the substitution of fuel injection systems for carburetors as the engine charge former.

Fuel injection systems typically inject fuel into the air intake manifold. In addition, direct injection systems are being considered to obtain still better engine performance. The direct fuel injection systems inject fuel directly into the combustion chamber and potentially have significant advantages over the indirect fuel injection systems including improved emission control.

Marine engines such as for outboard motors can employ direct or indirect fuel injection systems. Fuel for such systems typically is stored fuel tanks that are usually placed in the hulls of associated watercrafts. The watercraft of course is operated in water and hull often contains some amount of water at the location of the fuel tank. The user or operator thus fills the tank with fuel under the conditions that present the possibility of water entering the tank and mixing with the fuel.

Water within the fuel injection system tends to damage the system, especially if salt water is introduced into the system. Fuel injection systems are typically provided with fuel injectors, fuel pumps and regulators, all including elements made of iron that can easily rust in the presence of salt water. The damaging effects of salt water in the fuel supply is particularly detrimental to the fuel injectors. Fuel injectors are extremely precise and delicate, and do not function properly once rusted.

SUMMARY OF THE INVENTION

An aspect of the present invention involves the recognition that the introduction of a lubricant into the fuel reduces corrosion of the internal components within the fuel system, especially the internal components of the fuel injectors. If the fuel injected into the combustion chambers contains too much lubricant, however, lubricant is not only wasted, but it also produces white smoke in the exhaust gases and fouls the spark plugs of the engine, i.e., the spark plugs fail to spark due to deposits, which the lubricant likely produces, on their electrodes.

The present fuel injection system thus inhibits corrosion of its components, in the event that water, particularly salt water, is inadvertently mixed with fuel, by introducing an amount of lubricant into the fuel delivered to the engine through the fuel injection system. The amount of lubricant introduced into the fuel, however, is metered so as not to waste lubricant and to inhibit the presence of white smoke in the engine's exhaust and the fouling of the engine's spark plugs.

In one preferred application, a fuel injected, internal combustion engine is provided for a marine propulsion device. The engine comprises a combustion chamber. A fuel delivery system is arranged to deliver fuel for combustion in the combustion chamber. The fuel delivery system includes a fuel injector spraying the fuel. A lubricant delivery system is arranged to deliver lubricant to at least one portion of the engine that needs lubrication. An intermediate lubricant supply system operates between the lubricant delivery system and the fuel delivery system to supply lubricant from the lubricant delivery system to the fuel delivery system where the lubricant is mixed with the fuel. A control device is arranged to control an amount of lubricant supplied to the fuel delivery system through the intermediate lubricant supply system. In a preferred mode, the amount of lubricant delivered to the engine through the lubricant delivery system is greater than the amount of lubricant supplied to the fuel delivery system through the intermediate lubricant supply system.

In accordance with another aspect of the present invention, a method is provided for operating an engine. The engine has a combustion chamber, a fuel delivery system, a lubricant delivery system and a control device. The fuel delivery system includes a fuel injector. The method comprises delivering fuel to the fuel injector through the fuel delivery system and spraying the fuel by the fuel injector into the combustion chamber. Lubricant is delivered to at least one portion of the engine that needs lubrication through the lubricant delivery system. Lubricant also is supplied to the fuel delivery system to mix the lubricant with the fuel. The amount of lubricant supplied is controlled depending upon at least one operating parameter indicative of engine running condition.

Further aspects, features and advantages of this invention will become apparent from the detailed description of the preferred embodiments which follow.

BRIEF DESCRIPTION OF THE DRAWINGS

These and other features of this invention will now be described with reference to the drawings of preferred embodiments which are intended to illustrate and not to limit the invention. The drawings contain the following figures.

FIG. 17 is a graph showing a control map used to determine a coefficient of viscosity of the lubricant versus a lubricant temperature.

FIG. 18 is a graph showing temperature of a tip portion of the fuel injector as functions of engine speed and engine load.

FIG. 19 is a graph showing control map used to determine a target amount of the lubricant based upon engine speed and engine load.

FIG. 20(A) illustrates pulses of a control signal under a certain duty ratio. FIG. 20(B) illustrates that some of the pulses are omitted from the control signal. FIG. 20(C) illustrates that the duty ratio between pulses are reduced.

DETAILED DESCRIPTION OF THE PREFERRED EMBODIMENTS OF THE INVENTION

An exemplifying environment in which the present invention can be practiced will now be described with reference to FIGS. 1 to 7. The present fuel injection system has particular utility in the context of a marine engine, and thus, is described in the context of an outboard motor. The fuel injection system, however, can be used with other types of internal combustion engines employed in an environment in which the possibility of water entering the fuel supply system exists, e.g., with an engine driving a dredging pump.

Figure 1:
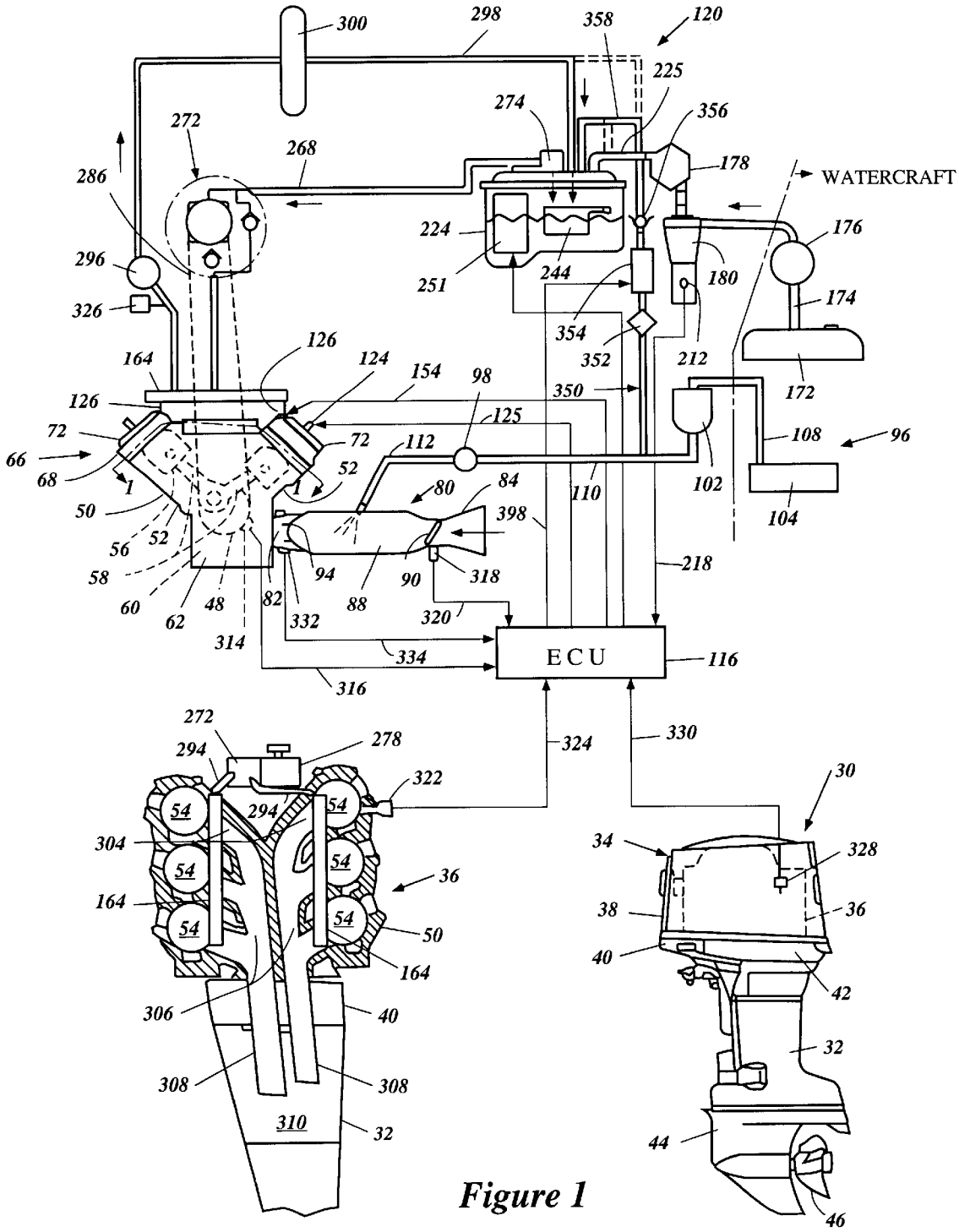
FIG. 1 is a multi-part view showing: in the lower right-hand portion, an outboard motor that employs a direct fuel injection system which relates to the present invention; in the upper view, a partially schematic cross-sectional view of the engine of the outboard motor with its air induction and fuel injection systems shown in part schematically; and in the lower left-hand portion, a rear elevational view of the outboard motor with portions removed and other portions broken away and shown in cross section as taken along the line 1—1 in the upper view so as to more clearly illustrate the construction of the engine, with the fuel injection system shown schematically in part. An ECU for the motor links the three views together.

With initial reference to FIG. 1, and in particular to the lower-right hand view of FIG. 1, an outboard motor 30 is depicted from the side. The entire outboard motor 30 is not depicted in that a swivel bracket and a clamping bracket, which are typically associated with a driveshaft housing 32, are not illustrated. These components are well known in the art and the specific method by which the outboard motor 30 is mounted to the transom of an associated watercraft is not believed necessary to permit those skilled in the art to understand or practice the invention.

The outboard motor 30 includes a power head 34 that is positioned above the driveshaft housing 32. The power head 34 comprises a protective cowling assembly and an internal combustion engine 36. This engine 36 is shown in more detail in the remaining two views of this figure and in FIGS. 2 and 3, and will be described shortly by reference thereto.

A protective cowling assembly includes a main cowling member 38 and a lower tray portion 40. Both the main cowling member 38 and the lower cowling portion 40 define a closed cavity in which the engine 36 is housed. The main cowling member 38 is detachably affixed to the lower cowling portion 40 so that the user or service person can access the engine 36 for maintenance service or for other purposes. The main cowling member 38 has air intake openings at its rear and upper end surface. Air thus can be introduced into the cavity. The lower cowling portion 40 encloses an exhaust guide member or upper portion 42 of the driveshaft housing 32. The engine 36 is affixed to the exhaust guide member 42 so as to be supported by the driveshaft housing 32.

A lower unit 44 is positioned beneath the driveshaft housing 32. A propeller 46, which forms the propulsion device for the associated watercraft, is journaled in the lower unit 44.

As is typical with the outboard motor practice, the engine 36 is enclosed in the power head 34 and its crankshaft 48 (see the upper view) rotates about a vertically extending axis. This facilitates the connection of the crankshaft 48 to a driveshaft (not shown) which depends into the driveshaft housing 32. The driveshaft drives the propeller 46 through a conventional forward, neutral, reverse transmission contained in the lower unit 44.

The details of the construction of the outboard motor and the components, which are not illustrated, may be considered to be conventional or of any type known to those wishing to utilize the invention disclosed herein. Those skilled in the art can readily refer to any known constructions with which to practice the invention.

The engine 36 of the illustrated embodiment is of the V6 type and operates on a two-stroke, crankcase compression principle. Although the invention is described in conjunction with an engine having this cylinder number and cylinder configuration, it will be readily apparent that the invention can be utilized with engines having other cylinder numbers and other cylinder configurations. Also, although the engine 36 will be described as operating on a two-stroke principle, it will be apparent to those skilled in the art that certain facets of the invention can be employed in conjunction with four-stroke engines.

The engine 36 comprises a cylinder body 50 that forms a pair of cylinder banks 52. Each of these cylinder banks 52 is formed with three vertically spaced, horizontally extending cylinder bores 54. Pistons 56 reciprocate in these cylinder bores 54. The pistons 56 are, in turn, connected to the small ends of connecting rods 58. The big ends of these connecting rods 58 are journaled on the throws of the crankshaft 48 in a manner that is well known in this art.

The crankshaft 48 is journaled in a suitable manner for rotation within a crankcase chamber 60 that is formed in part by a crankcase member 62 that is affixed to the cylinder body 50 in a suitable manner. As is typical with the two-stroke engines, the portion of the crankcase chamber 60 associated with each of the cylinder bores 54 are sealed from each other. This type of construction is well known in the art.

Cylinder head assemblies 66 are affixed to the ends of the respective cylinder banks 52 that are spaced from the crankcase chamber 60. Each cylinder head assembly 66 comprises a cylinder head member 68 that defines a plurality of recesses in its inner face. Each of these recesses cooperates with the respective cylinder bore 54 and the head of the piston 56 to define the combustion chambers of the engine 36. Cylinder head cover members 72 complete the cylinder head assemblies 66. The cylinder head members 68 and cylinder head cover members 72 are affixed to each other and to the respective cylinder banks 52 in a suitable known manner.

The engine 36 includes an air induction system 80. The air induction system 80 delivers an air charge to the sections of the crankcase chamber 60 associated with each of the cylinder bores 54. This communication is via an intake port 82 that is formed in the crankcase member 62 and registers with the respective crankcase chamber section.

The induction system 80 includes an air silencing and inlet device 84. This inlet device 84 is contained within the forward end of the main protective cowling 38 and has a rearwardly facing air inlet opening 86. The air introduced into the closed cavity of the protective cowling assembly is pulled into the air inlet device 84 through the air inlet opening 86. The air inlet device 80 delivers the air to a plurality of throttle bodies 88, each of which has a throttle valve 90 provided therein. These throttle valves 90 are journaled on throttle valve shafts which are linked together for simultaneous opening and closing of the throttle valves 90 in a manner that is well known in this art.

As is typical in the two-stroke engine practice, the intake ports 82 have provided in them reed-type check valves 94. These check valves 94 permit the air to flow into the sections of the crankcase chamber 60 when the pistons 56 are moving upwardly in their respective cylinder bores 54. However, as the pistons 56 move downwardly, the charge will be compressed in the sections of the crankcase chamber 60. At that time, the reed type-check valves 94 will close so as to permit the charge to be compressed.

Figure 3:
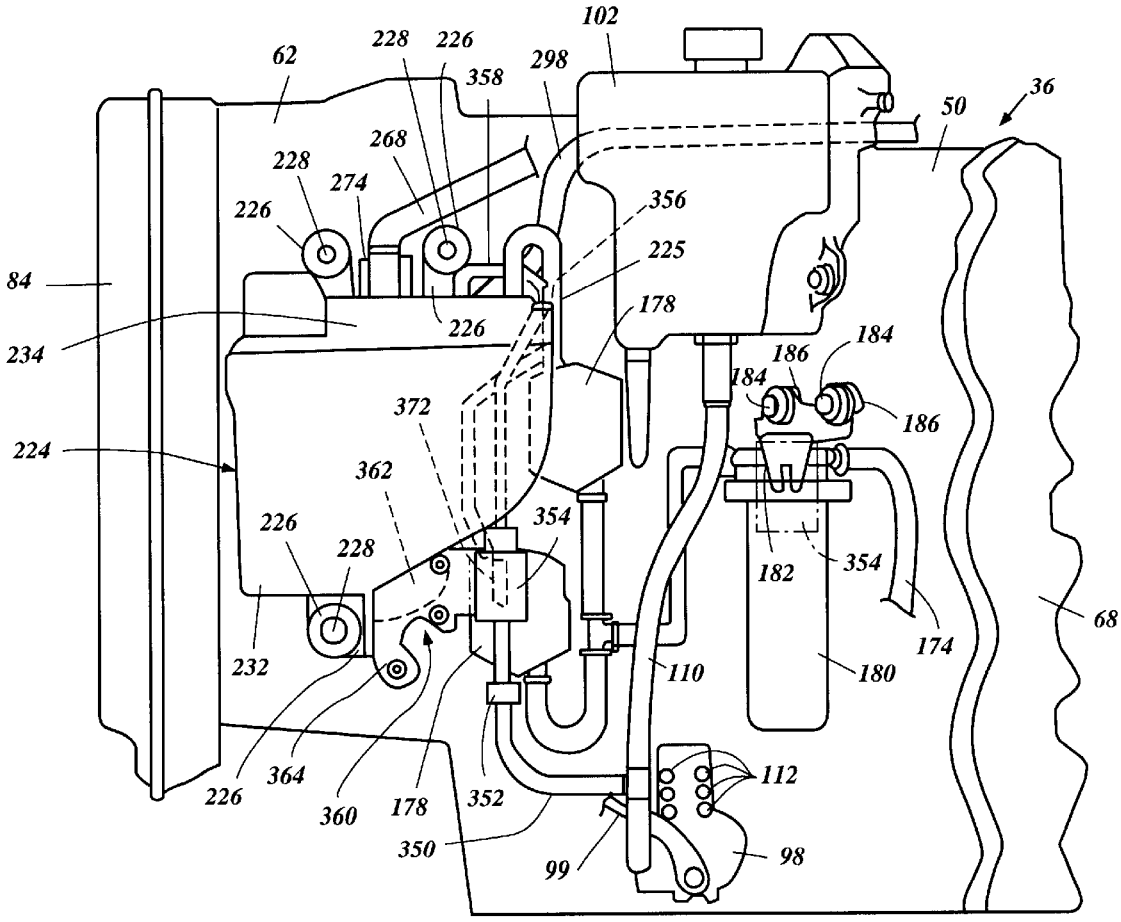
FIG. 3 is a partial elevational side view of the engine looking in the direction of the Arrow 3 of FIG. 2.

In the illustrated embodiment, an engine lubrication system 96 is provided. The engine lubrication system 96 includes a lubrication pump 98 that deliver lubricant to the respective throttle bodies 88 so that the lubricant can reach to certain portions of the engine 36 which need lubrication along with the introduced air. The lubrication pump 98, as configured as seen in FIG. 3, is mounted on the cylinder body 50. The lubrication pump 98 has an adjustment lever 99 that is linked with the shafts of the throttle valves 90 so that an amount of the lubricant is adjusted in response to various states of the engine operations. The engine portions that need lubrication are, for example, connecting portions of the connecting rods 58 with the pistons 56 and also with the crankshaft 48. In the illustrated embodiment, the lubrication pump 98 is driven by an electric motor. Otherwise, it can be driven by the crankshaft 48 or the like.

In order to supply the lubricant to the lubrication pump 98, a main lubricant tank 102 and a sub-tank 104 are provided in the lubrication system 96. The main tank 102 is mounted on one bank 52 of the engine 36 where the lubrication pump 98 is disposed, while the sub-tank 104 is placed in the hull of the associated watercraft. The main tank 102 is affixed to the cylinder body 50, part to the top surface thereof and other part to the side surface thereof. The sub-tank 104 is coupled to the main tank 102 through a conduit 108 and the main tank 102 is coupled to the lubrication pump 98 through a supply conduit 110. The lubrication pump 98, in turn, is coupled to the respective throttle bodies 88 through six delivery conduits 112.

Some forms of direct lubrication can be additionally employed for delivering lubricant directly to certain components or systems of the engine 36. In the illustrated embodiment, a fuel injection system or fuel supply system 120 (see the upper and lower left-hand views of FIG. 1) that will be described later has special lubrication units. The lubrication for the fuel injection system 120 will be described below in great detail.

With reference again to the air induction system 80, the air charge that is compressed in the sections of the crankcase chamber 60 is then transferred to the combustion chambers through a scavenging system. This scavenging system preferably is of the Schnurle type and includes a pair of main scavenge passages for each cylinder bore 54 that are positioned on diametrically opposite sides. These main scavenge passages terminate in main scavenge ports so as to direct scavenge air flows into the combustion chamber.

In addition, an auxiliary scavenging passage is formed between the main scavenge passages and terminates in an auxiliary scavenging port which also provides scavenging air flow. Thus, during the scavenging stroke, the intake charge will be transferred to the combustion chambers for further compression as the pistons 56 move upwardly from their bottom dead center position so as to close the scavenge ports and further compress the charge.

The engine 36 also includes a firing or ignition system. Spark plugs 124 are affixed to plug bosses formed at the cylinder head members 68. Their respective spark gaps are exposed to the combustion chambers. The spark plugs 124 are fired under control of an ECU (Engine Control Unit) 116, shown schematically in FIG. 1, through a control signal line 125. The ECU 116 also controls other systems of the engine 36 as will be described later. Incidentally, the foregoing lubrication pump 98 can be controlled by the ECU 116 instead linked with the throttle valves 90.

The ECU 98 receives certain signals for controlling the time of firing of the spark plugs 124 in accordance with any desired control strategy. The spark plugs 124 thus fire air/fuel charges that are formed in the illustrated embodiment from fuel sprayed directly into the combustion chambers by fuel injectors 126 and the air delivered to the combustion chambers through the scavenge system.

Figure 4:
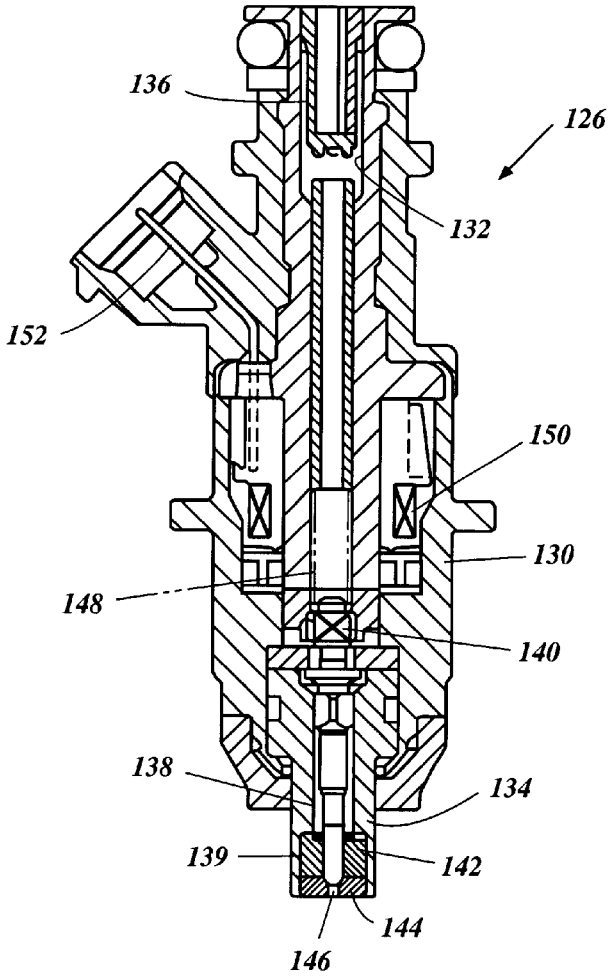
FIG. 4 is a cross-sectional view of a fuel injector employed for the direct fuel injection system.

In the illustrated embodiment, the fuel injectors 126 are the inner-valve types and are electrically operated also under control of the ECU 116. FIG. 4 illustrates an exemplary fuel injector 126 of this type.

The fuel injector 126 includes an injector body 130 defined by several members. The injector body 130 has a through-hollow 132. An injection nozzle 134 is fitted into the hollow 132 at one end of the body 130. A fuel filter 136 is affixed to the other end of the body 130. The injection nozzle 134 has also a through-hole 138 that is connected to the hollow 132 of the injector body 130. The through-hollow 132 of the injector body 130 and the through-hole 138 of the injection nozzle 134 are filled with pressurized fuel when the engine is running.

A swirl member 139 is fitted into the through-hole 138 that has a swirl passage to give a swirling movement to the fuel that will be injected. A slide rod or plunger 140 is slideably supported in both the through-hollow 132 of the body 130 and the through-hole 138 of the nozzle 134. The slide rod 140 has a needle valve member 142 at its end portion within the injection nozzle 134. The needle valve member 142 is seated on a valve seat member 144 that is affixed to the end portion of the nozzle 134. The valve seat member 144 has an injection opening 146 that is normally closed by the needle valve member 142.

The other end portion of the slide rod 140 is urged by a coil spring 148 toward the injection opening 146 so that the needle valve member 142 closes the opening 146. A solenoid 150 is embedded in the injector body 140 around this end portion of the slide rod 140. Electric wires 152 couples the solenoid coil 148 with an electric power source such as a battery through a switching element. A control signal 154 (see FIG. 1) that comes from the ECU 116 can switch this connection. When the signal 154 switches to close the connection, the solenoid coil 148 pulls the slide rod 140 to open the injection opening 142. In the illustrated embodiment, the slide rod 140 has a stroke length of sixty (60) microns.

Figure 5:
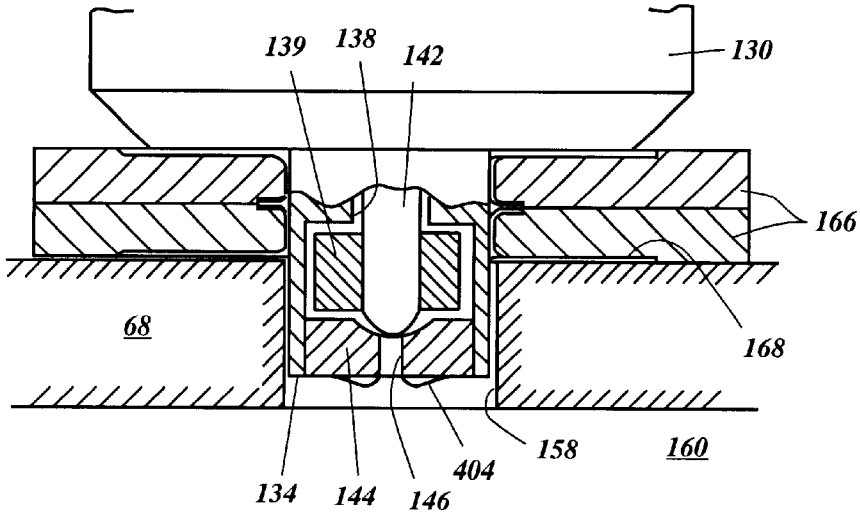
FIG. 5 is an enlarged view of a portion of the fuel injector attached to the engine. Part of the view is shown in section.

The fuel injectors 126 are mounted on the cylinder head members 68. As seen in FIG. 5, the injection nozzle 134 of each injector 126 is fitted into a through-hole 158 formed through the cylinder head member 68 so as to expose the injection opening 146 toward the combustion chamber, which is designated by the reference numeral 160 in this figure. The injector bodies 130 are pressed toward outer surfaces of the cylinder head members 68 by fuel rails 164, which will be described shortly. A couple of ring-shaped gaskets 166 partially covered with stainless coat members 168 are interposed between each injector body 130 and the cylinder head members 68.

As noted above, each needle valve 142 is normally seated on the valve seat member 144 to close the injection opening 146 by the biasing force of the spring 148. When a control signal is given from the ECU 116 through the control signal line 154, the solenoid 150 pulls the slide rod 140 so as to move the needle valve 142 from the valve seat 144. The pressurized fuel is thus injected or spayed into the combustion chamber 160.

Generally, the pressurized fuel is supplied by the fuel supply system 120 and its pressure is strictly regulated to be a constant value all the time. The ECU 116 controls duration of each injection so as to give a proper amount of the fuel in response to various states of the engine operations. That is, air/fuel ratios of the respective cylinders are controlled separately from each other.

The fuel supply system 120 comprises a fuel supply tank 172 that is provided in the hull of the watercraft. The fuel is drawn from this tank 172 through a conduit 174 by a first low pressure pump 176 and a plurality of second low pressure pumps 178. The first low pressure pump 176 is a manually operated pump, while the second low pressure pumps 178 are diaphragm type pumps operated by pulsating variations in pressure that occur in the sections of the crankcase chamber 60. As seen in FIG. 3, actually two low pressure pumps 178 are provided in parallel location with each other in this embodiment and they are mounted on the crankcase member 62. A quick disconnect coupling is provided in the conduit 174 so as to detachably connect the watercraft side of the conduit 174 with the outboard side thereof.

Figure 2:
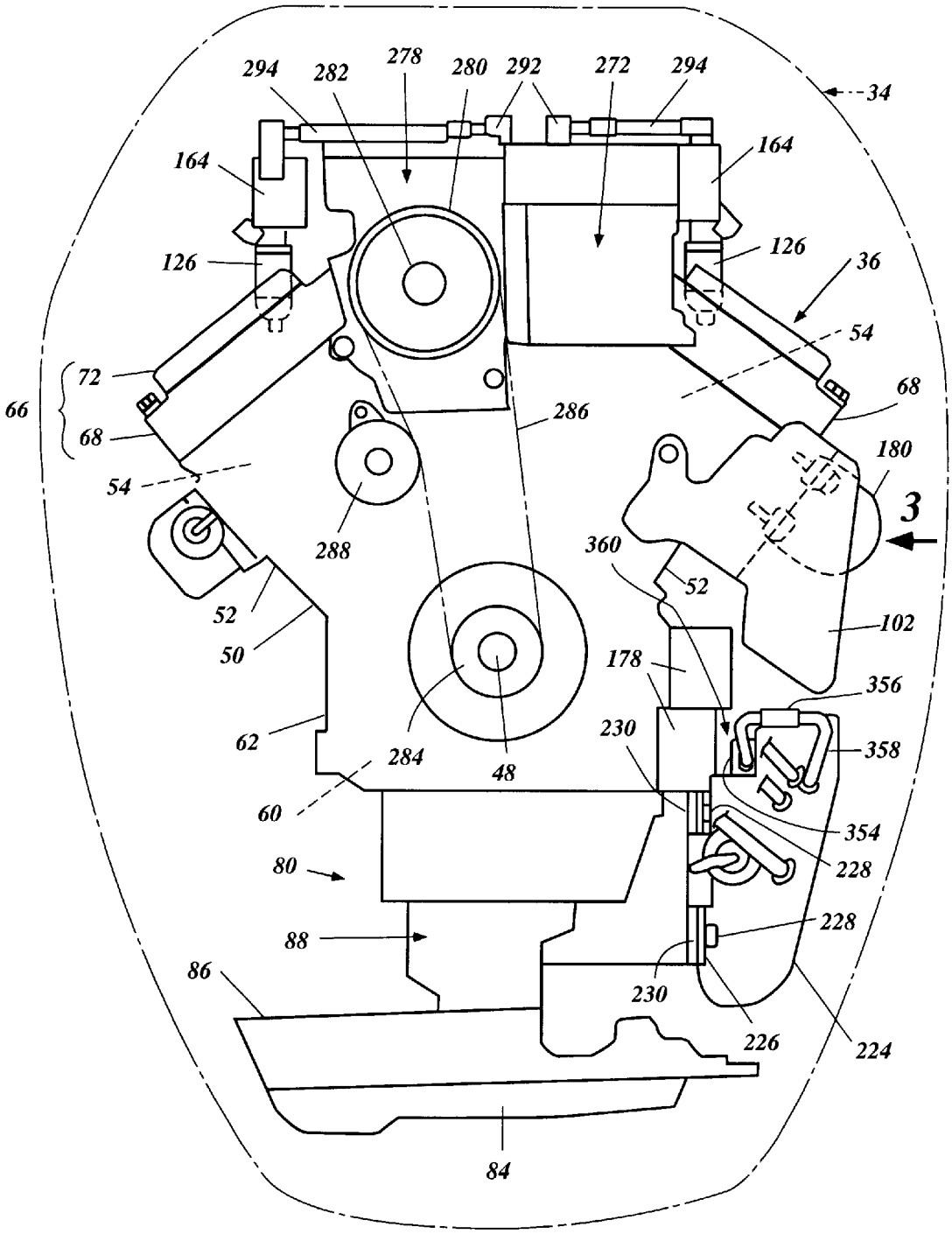
FIG. 2 is a top plan view showing a power head of the outboard motor that incorporates the engine. The engine is illustrated in solid, and a protective cowling of the power head, which encloses the engine, is illustrated in phantom.

As seen in FIGS. 1 to 3, a fuel filter 180 is positioned in the conduit 174. The fuel filter 180 is mounted on the cylinder body 50. The fuel filter 180 is disposed on the same side where the lubrication pump 98 is mounted, and generally between the lubrication pump 98 and the main lubricant tank 102. Preferably, the fuel filter 180 is attached to a stay 182 in an appropriate manner. The stay 182 is then affixed to the cylinder body 50 by bolts 184 via ring-shaped elastic members 186 made of rubber material. The fuel filter 180 is thus well isolated from vibrations of the engine 36.

Figure 6:
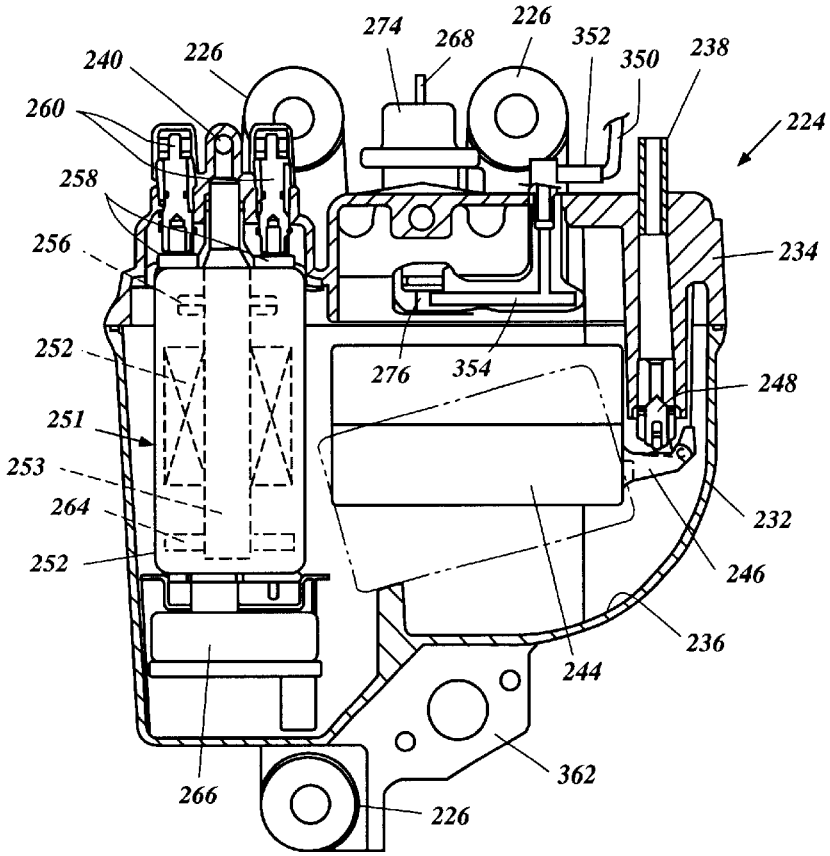
FIG. 6 is a cross-sectional view of a fuel filter including a water sensing system of the fuel injection system.

FIG. 6 illustrates a detailed construction of the fuel filter 180. The fuel filter 180 comprises a container 190, a cap 192 having an inlet port 194 and an outlet port 196, and a coupling member 198 that couples together the container 190 and the cap 192. The coupling member 198 supports a flange portion of the container 190 disposed atop thereof and then affixes itself to the outer surface of the cap 192 by a screw connection.

The container 190 has an inner projection 200 at its bottom that projects inwardly and upwardly. The projection 200 is formed with a through-hole. A strut 202 is fitted into the through-hole so as to stand up within the container 190. The strut 202 has a rack 204 atop thereof. The rack 204 supports a filter element 205. The rack 204, in turn, is supported by a coil spring 206 that is mounted on an inner flange 207 via a washer 208. The inner flange 207 is formed at an inner surface of the container 190. Meanwhile, the top of the filter element 205 is confined in a frame member 209 that extends from the cap 192. The filter element 205 is thus caught between the rack 204 and the frame member 209. The inlet 194 and the outlet 196 are coupled together only through the filter element 205.

Water may accumulate in the container 190 because the fuel for this kind of marine engine is replenished in the hull or open deck under the condition that water can enter the fuel supply tank 172. In the illustrated embodiment, the fuel filter 180 thus includes a water sensing system 212. The water sensing system 212 comprises a float 214, a reed switch 216 and magnets embedded in the float 214 around the strut 202. The float 214 is made of plastic material that has a specific gravity greater than that of the fuel, i.e., gasoline, in the embodiment, but less than that of water. The float 214 can move up and down along the strut 202 through a hole of the washer 208. The reed switch 216 is positioned at a certain height in the strut 202 and is connected to the ECU 116 through a signal line 218.

The fuel from the first low pressure pump 176 is introduced into the container 190 through the inlet 194 and filtered by the filter element 205 so as to remove foreign substances. The fuel then goes to the second low pressure pumps 178 through the outlet 196. Since the specific gravity of water is greater than that of gasoline, the water accumulates below the fuel, if it is contained in the supplied fuel. The float 214, which has the specific gravity less than water, and will generally float on the surface of the water. Under the circumstances, if the water accumulates to a predetermined level, i.e., to the height where the reed switch 216 is positioned, the magnets approach the reed switch 216 so as to close the switch 216 and send a signal to the ECU 116 through the signal line 218.

The ECU 116 will control lubrication of the fuel injection system 120 by using the water-sensing signal, as will be described later. The water-sensing signal 218 also can be used to indicate that a relatively great volume of water has accumulated in the container 190 via an indicator (e.g., warning lap) or alarm. When recognizing the indication or hearing the alarm, the user stops engine operation and empties the water from the container 190 by detaching the container 190 from the cap member 198.

The coil spring 206 primarily supports the filter element 205 as noted above. It is, however, also useful to keep the water surface calm because the spring 206 slows down the fuel that flows into the container 190. Of the spring 206 were not provided, the fuel flow would churn the water.

With the continued reference to FIG. 1, the fuel is supplied to a vapor separator 224 from the second low pressure pump 178 through a fuel line 225. The vapor separator 224 is, as is well known in the art, a fuel reservoir that can separate vapor from liquid so as to prevent vapor lock from occurring in the fuel injection system 120. As seen in FIGS. 2 and 3, the vapor separator 224 is mounted on the crankcase member 62 and on the same side of the engine 36 where the lubricant tank 102 is disposed. The vapor separator 224 has three stays 226 uniformly formed with the body of the vapor separator 224. The stays 226 are affixed to the crankcase member 62 by bolts 228 via elastic members 230 preferably made of rubber material.

Figure 7:
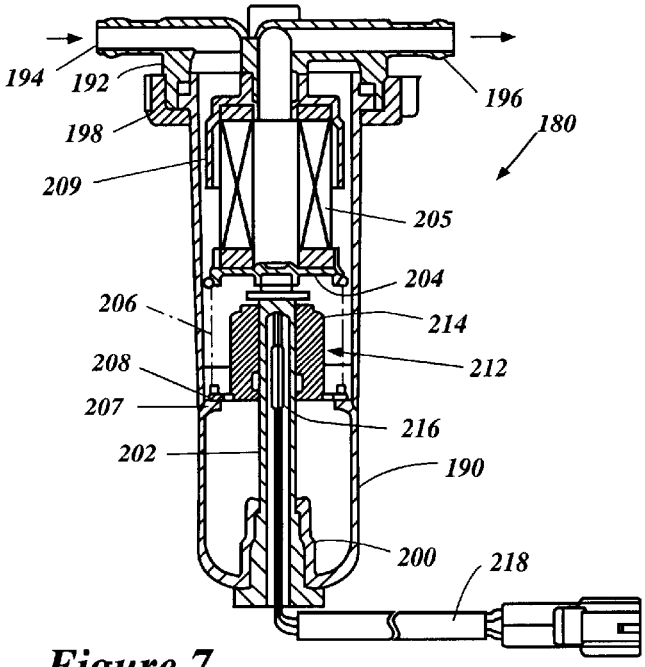
FIG. 7 is a cross-sectional view of a vapor separator of the fuel injection system.

FIG. 7 illustrates a detailed construction of the vapor separator 224. The body of the vapor separator 224 is generally defined by two pieces 232, 234. The bottom piece 232 forms a cavity or fuel reservoir portion 236, while the top piece 234 forms a lid to the bottom piece 232 and also has a fuel inlet port 238 and a fuel outlet port 240.

A float 244 is provided in the cavity 236. The float 244 has a lever portion 246 on which a needle valve 248 is pivotally affixed. The needle valve 248 opens and closes the inlet port 238 with the floating movement of the float 244. That is, when an amount of the fuel in the cavity 236 decreases, the float 244 falls and the needle valve 248 opens the inlet port 238 to allow the fuel to flow into the cavity 236. Conversely, when the amount of the fuel increases, the float 244 rises and the needle valve 248 closes the inlet port 238 to prevent the fuel from entering the cavity 236.

A high pressure electric pump 251 is also provided in the cavity 236 and is disposed next to the float 244. The electric pump 251 comprises a housing 252, an electric motor section, a pump section and a common shaft section 253. Both the motor section and pump section is generally formed around the shaft section 253 within the housing 252. Actually, the motor section forms a conventional DC motor.

The motor section includes coils 254 wound around core members, a brush 256 and terminals 258. Couplers 260, which are coupled with the terminals 258, connect the terminals 258 to the battery so as to supply electric power to the motor section, and to the ECU 116 through a control line 262 (see FIG. 1) so as to drive the motor section under control of the ECU 116. Since the internal cavity of the housing 252 is filled with the fuel, all the elements of the motor section including the coils 252 and brush 256 are soaked in the fuel. This construction is advantageous because the fuel can efficiently remove heat from the elements.

The pump section includes a pump impeller 264. An internal cavity of the housing 252 communicates with the cavity 236 via an internal filter 266 and also with the outlet port 240 through passages that are not shown in the figure. The motor section rotates the shaft section 253 so that the impeller 264 introduces the fuel in the cavity 236 into the housing 251 and pressurizes it to a certain level.

Through a fuel supply line 268, the pressurized fuel is delivered to a high pressure fuel pump unit 272 that can pressurize the fuel to higher level. The high pressure fuel pump unit 272 is illustrated schematically in FIG. 1. In a preferred embodiment, the electric fuel pump 251 develops a pressure, for example, 3 to 10 kg/cm$^2$. The high pressure fuel pump unit 272 preferably develops a pressure, for example, 50 to 100 kg/cm$^2$ or more. A low pressure regulator 274 is positioned in the line 268 and at the vapor separator 224 and limits the pressure that is delivered to the high pressure fuel pump unit 272 by dumping the fuel back to the vapor separator 224. As seen in FIG. 7, actually the pressure regulator 274 communicates with the cavity 236 through an inner conduit 276. These pressure valves merely exemplify one suitable mode of operation, and the engine can be operated at other fuel pressures.

As best seen in FIG. 2, the high pressure fuel pump 272 is mounted on a pump drive unit 278 that drives the fuel pump 272. The pump drive unit 278, in turn, is mounted on the cylinder body 50 in a proper manner. The pump drive unit 278 is further affixed to the cylinder block 50 so as to overhang between the two banks 52 of the V arrangement. A pulley 280 is affixed to a pump driveshaft 282 of the pump drive unit 278. The pulley 282 is driven by a drive pulley 284 affixed to the crankshaft 46 through a drive belt 286. A belt tensioner 288 is provided for tensioning the belt 286.

The pump drive unit 278 includes a cam disc disposed on the pump driveshaft 282 and engaged with plungers of the high pressure fuel pump unit 272. The high pressure fuel pump unit 272 thus pressurizes the fuel with the plungers when the cam disc pushes them with the rotation of the pump driveshaft 282 of the pump drive unit 278.

The high pressure fuel pump unit 272 has fuel outlet ports 292 that are coupled to the fuel rails 164 through flexible conduits 294. The fuel rails 164 are made of rigid metal material and are affixed to the respective cylinder head assemblies 66 so as to extend generally vertically. The fuel injectors 126 are attached to the fuel rails 164 so as to extend toward the respective cylinders. The fuel rails 164 define not only such mounting members of the fuel injectors 126 but also fuel passages that communicate with the flexible conduits 294 and also the through-hollows 132 of the fuel injectors 126. Accordingly, the pressurized fuel is supplied to the respective fuel injectors 126.

With reference again to FIG. 1, the pressure of the fuel supplied by the high pressure fuel pump unit 272 is regulated to a fixed or constant value by a high pressure regulator 296 that dumps fuel back to the vapor separator 224 through a pressure relief line 298 in which a fuel heat exchanger or cooler 300 is provided. As described above, it is important to keep the fuel under the constant pressure because fuel injection amounts are determined by changes of duration of injection under this constant fuel pressure.

Each of the fuel injectors 126 sprays fuel directly into the combustion chamber from its injection nozzle 134. The sprayed fuel or fuel charge expands into the combustion chamber 72. The fuel charge is fired by the spark plugs 124. The injection timing and duration, and the firing timing are all controlled by the ECU 116.

Once the charge burns and expands, the pistons 56 will be driven away from the cylinder head in the cylinder bores 54 until the pistons 56 reach the bottom dead center position. At this time, exhaust ports will be uncovered so as to open the communication with an exhaust passage 304 formed in the cylinder body 50. The burnt charge or exhaust gases flow through the exhaust passages 304 to exhaust manifold sections 306 that are also formed within the cylinder body 50.

A pair of exhaust pipes 308 depend from the lower tray portion 40 and extend into an expansion chamber 310 formed in the driveshaft housing 32. From this expansion chamber 310, the exhaust gases are discharged to the atmosphere through a suitable exhaust system. As is well known in outboard motor practice, this may include an underwater, high speed exhaust gas discharge and an above the water, low speed exhaust gas discharge. Since these types of systems are well known in the art, a further description of them is not believed to be necessary to permit those skilled in the art to practice the invention.

A feedback control system including the ECU 116 is provided for control of engine operation. The injection timing and duration control and the firing timing control are included in this feedback control. The feedback control system includes, as well as the ECU 116, a number of sensors that sense either engine running conditions, ambient conditions or conditions of the outboard motor 30 that will affect engine performance.

Certain sensors are shown schematically in FIG. 1 and will be described by reference to that figure.

For example, there is provided a crankshaft angle position sensor 314 that, when measuring crankshaft angle versus time, outputs a crankshaft rotational speed signal or engine speed signal to the ECU 116 through a signal line 316.

Operator demand or engine load, as determined by a throttle angle of the throttle valve 90, is sensed by a throttle position sensor 318 which outputs a throttle position or load signal 320 to the ECU 116. When the operator desires to increase speed, i.e., accelerate, the operator operates a throttle lever (not shown). The throttle valve 90 is consequently opened toward a certain open position that corresponds to the desired speed. Correspondingly, more air is introduced into the crankcase chamber 60 through the throttle bodies 88. The engine load also increases when the associated watercraft advances against wind. In this situation, the operator also operates the throttle so as to maintain the desired speed.

A combustion condition or oxygen ($O_2$) sensor 322 senses the in-cylinder combustion conditions by sensing the residual amount of oxygen in the combustion products or exhaust gases at a time near the time when the exhaust port is opened. The sensor 322 in this embodiment senses the conditions in a cylinder bore 54 that positioned atop of one bank of the cylinder body 50. This output and air/fuel ratio signal is indicted at 324 that goes to the ECU 116.

There is also provided a pressure sensor 326 that is connected to the pressure regulator 296. This pressure sensor 326 outputs the high pressure fuel signal to the ECU 116. The signal line is not shown in FIG. 1.

A water temperature sensor 328 may also be provided for outputting a cooling water or engine temperature signal 330 to the ECU 116. This signal 330 can be substituted for a lubricant temperature signal.

Further, an intake air temperature sensor 332 is provided and this sensor 332 outputs an intake air temperature signal 334 to the ECU 116.

Although these sensors are shown in FIG. 1, it is of course practicable to provide other sensors such as an engine height sensor, a trim angle sensor, a knock sensor, a neutral sensor, a watercraft pitch sensor and an atmospheric temperature sensor in accordance with various control strategies.

Additionally, other engine components such as, for example, a starter motor arranged to start the engine 36 and a flywheel assembly including a generator are provided, although not shown.

As has been noted, water may occasionally enter the fuel supply tank 104 with high frequency in connection with a marine engine like the engine 36 in the illustrated embodiment. If this occurs, corrosion can seriously damage the fuel injection system 120. Particularly, the fuel injectors 126 are highly sophisticated, precise device and hence must be inhibited from rusting. Other components of the fuel injection system 120 may have similar problems with rust, but to a lesser degree.

In addition, in the illustrated embodiment, the motor section of the electric fuel pump 251 is soaked in the fuel. Under the circumstances, the water mingled with the fuel can cause following problems. First, motor elements such as bearings corrode to make noise, vibrations and frictions. This causes further power loss. Second, if the water includes impurities such as salt content, a local short circuit occurs at the brush 256 to expedite wear thereof Third, the water electrolyzes at the brush 256, and metallic cations and hydroxyl radicals together make the neutralization reaction to produce salts (hydroxide substances). That is, foreign substances come into existence in the fuel. Such foreign substances in the fuel cause problems such that the pressure loss of the fuel increases.

In the illustrated embodiment, therefore, the engine 36 has an intermediate lubricant supply system that supplies lubricant to the fuel injection system 120 for protecting components thereof from rusting. In addition, the ECU 116 controls an amount of the lubricant supplied to the injection system 120.

With reference to FIGS. 1 to 3 and 7 to 10, the intermediate lubricant supply system includes a lubricant branch conduit 350 is provided for supplying the lubricant to the fuel injection system 120 from the lubrication system 96. The lubricant branch conduit 350 is branched off between the main lubricant tank 102 and the lubrication pump 98 in the supply conduit 110. As best seen in FIG. 7, the other end of the branch conduit 350 is connected to a lubricant inlet port 352 of the vapor separator 224. The lubricant inlet port 352 communicates with the inner conduit 276 and thus the lubricant is introduced into the cavity 236 with the fuel. Alternatively, the other end of the branch conduit 350 can be connected to the pressure relief line 298 or to the fuel line 225 as indicated in dotted lines in FIG. 1.

In the branch conduit 350, there are provided a lubricant filter 352, a premix lubrication pump 354 and a check valve 356. The lubricant filter 352 is provided for removing foreign substances from the lubricant because such foreign substances can damage the fuel injection system 120, particularly the fuel injectors 126. The check valve 356 is provided for preventing fuel from flowing into the lubricant supply conduit 110.

In the illustrated embodiment, a part 358 of the branch conduit 350, which couples the check valve 356 with the inlet port 350 of the vapor separator 224, is preferably formed with a transparent material. Because of this, the user or service person can easily ascertain that lubricant is being supplied to the vapor separator 224 under the engine running condition.

The premix lubrication pump 354 pressurizes the lubricant to the vapor separator 224. The vapor separator 224 defines a recess 360 (see FIGS. 2 and 3) at its bottom and rear portion. As seen in FIGS. 3 and 7, a rig 362 is uniformly formed with the bottom piece 232 of the vapor separator 224. The premix pump 354 is affixed to the rig 362 by a stay 364.

As noted above, the vapor separator 224 is affixed to the crankcase member 62 via the elastic members 230. The premix pump 354, which is affixed to this vapor separator 224, also is isolated from engine vibrations. Otherwise, the premix pump 354 can be affixed to the stay 182 of the fuel filter 180 to obtain the same effect, because the stay 182 also is affixed to the engine body 50 via the elastic members 186.

Figure 8:
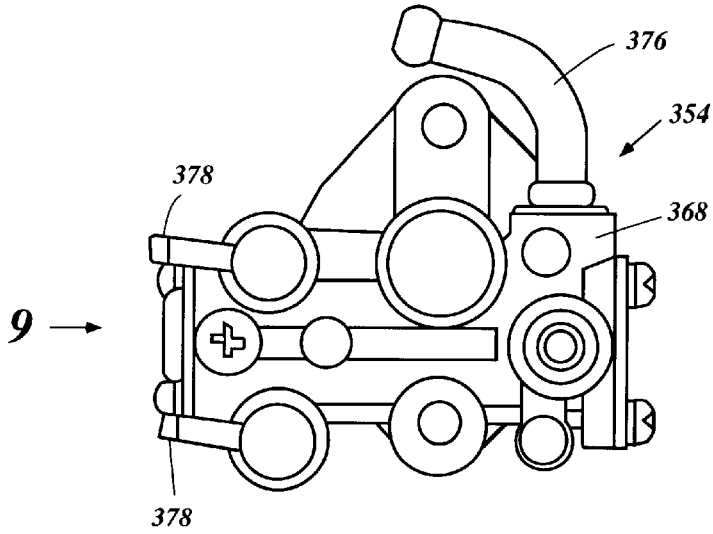
FIG. 8 is a side view of a plunger-type, premix lubricant pump.
Figure 9:
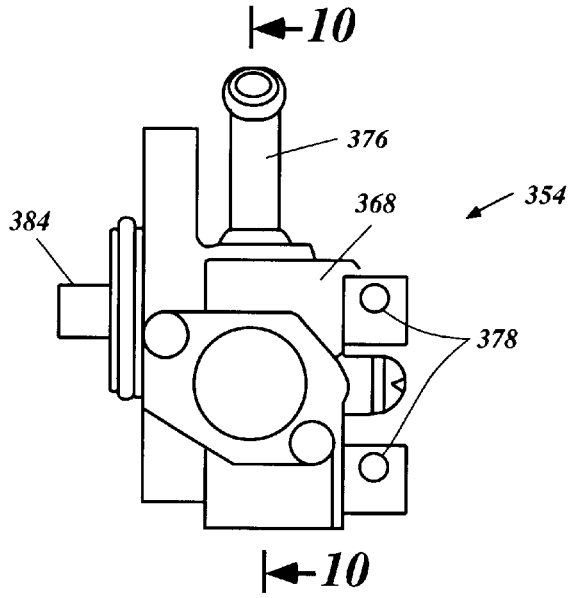
FIG. 9 is another view of the lubricant pump looking in the direction of the Arrow 9 of FIG. 8.
Figure 10:
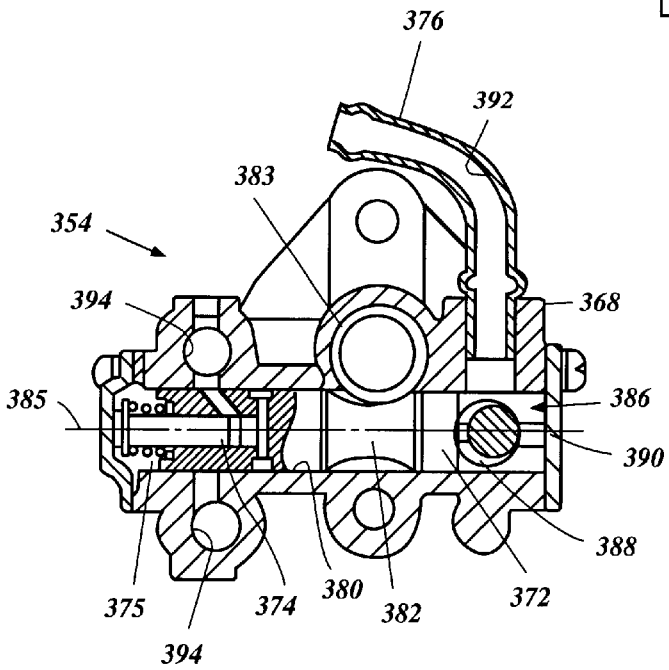
FIG. 10 is a cross-sectional view of the lubricant pump taken along the line 10—10 of FIG. 9.

Any type of pump device can be employed as the premix lubrication pump 354. FIGS. 8 to 10 illustrate an exemplary, plunger-type pump.

The plunger-type pump, still indicated by the reference numeral 354, comprises a pump body 368, a plunger 372, a sub-plunger 374, a coil spring 375, an inlet port 376 and outlet ports 378. The pump body 368 defines a cylindrical bore 380 and supports slideably and rotatably the plunger 372 that is coupled together with the sub-plunger 374. The plunger 372 has a gear portion 382.

A worm gear 383 is provided in another cylindrical bore formed in the pump body 368. The worm gear 383 has a gear shaft 384, which axis extends normal to an axis 385 of the plunger 372, and is meshed with the gear portion 382 so as to rotate the plunger 372.

A camshaft 386 is provided to extend normal to the plunger axis 385. The camshaft 386 has a large cam 388 and a small cam 390, both are configured right circles but decentered from an axis of the camshaft 386. The coil spring 375 normally biases the plunger 372 in the right direction in FIG. 10. Either one of the large or small cam 388, 390 can push back the plunger 372 in the opposite direction alternately with the rotation of the camshaft 386.

The worm gear shaft 384 and the camshaft 386 are connected to an electric motor through a drive mechanism (both are not shown) so as to be driven by the electric motor.

The inlet port 376 communicates with the bore 380 through an inlet passage 392, while the bore 380 also communicates with the outlet ports 378 through outlet passages 394. In addition, inner passages are internally formed within the plunger 372 and sub-plunger 374 so as to connect the inner passages 392 with the outer passages 394.

When the motor drives the warm gear shaft 384 and the cam shaft 386, the plunger 372 and the sub-plunger 374 rotate and reciprocate within the bore 380. With this rotational and reciprocal movement, the lubricant is introduced into bore 380 through the inlet passage 392. The lubricant is then transferred to the outlet passages 394 through the inner passages and pushed out from the outlet ports 378.

In the illustrated embodiment, the plunger 372 extends generally vertically in parallel to the crankshaft 48 as seen in FIG. 3. This arrangement is advantageous because engine vibrations, which are particularly caused by the horizontal movement of the pistons 56, hardly affect the premix pump 354.

Such a plunger-type pump device is conventional and is well known in the art. Other types of pump devices, such as, for example, an electromagnetic-type pump, are of course also practicable. The electromagnetic-type pump is also well known.

The fuel injection system 120 needs lubricant only to protect the components from rusting by the water inadvertently mixed with the fuel. It has been found that the lubricant easily adhere to the components to coat over them and only a small amount of the lubricant is necessary to keep this condition. In other words, a large amount of lubricant is not necessary. Moreover, such a large amount of lubricant is undesirable because white smoke will be produced and also the spark plugs 124 are likely to fail proper ignitions due to deposits, which are produced with the lubricant, on their electrodes caused by the lubricant. The ECU 116, therefore controls the pump 354 through a signal line 398 (see FIG. 1) to regulate an amount of lubricant so as to introduce a proper volume.

A various control methods to supply this lubrication can be practiced.

Figure 11:
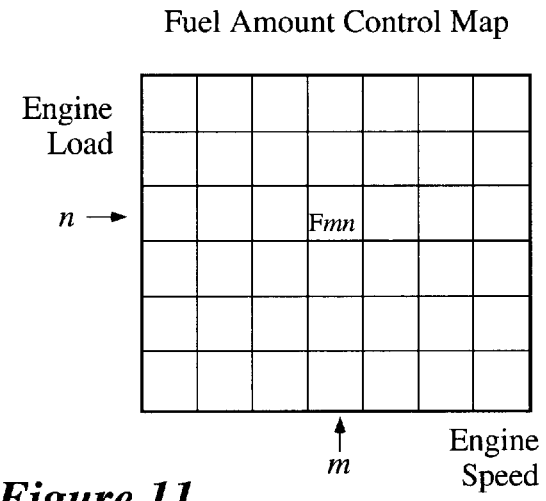
FIG. 11 is a graph showing a control map used to determine an injection amount of fuel based upon an engine speed versus an engine load.

Before describing a first control method, generally, the ECU 116 stores in memory a fuel amount control map for the fuel injectors 126 that is shown in FIG. 11. In this map, an engine speed is indicated on the horizontal line, while an engine load is indicated on the vertical line. For example, if the engine speed is "m" and the engine load is "n", then a fuel amount is determined as "$F_{mn}$". The ECU 116 calculates an amount of the lubricant "F" with this value "$F_{mn}$" by the following formula:

$$F=F_{mn}\times C \text{ (}C\text{: constant)}$$

Actually, the fraction value 1/2000 is preferably selected as the constant value. A value in a range 1/250 to 1/2000 is preferred. If the value is greater than 1/200, the plug fouls may increase and thus it is not preferred; a value less than 1/2000 may not maintain the proper coating of the components. The premix lubrication pump 354 doses such an extremely small amount of lubricant. The premix pump 354, thus, supplies this amount of the lubricant to the vapor separator 224. This method can provides a proper lubricant amount to the fuel injection system 120 at all times in accordance with the engine's speed and load. Incidentally, in other methods described below, the premix lubrication pump 354 functions in a similar manner.

Figure 12:
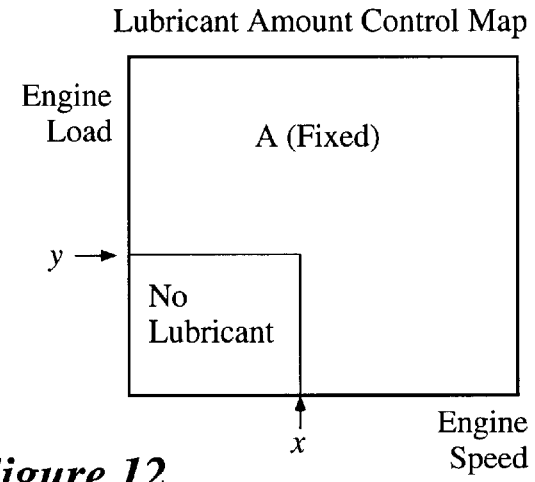
FIG. 12 is a graph showing a control map used to determine an amount of lubricant based upon the engine speed versus the engine load in accordance with a first control method.

FIG. 12 illustrates a lubricant amount control map for a first method of operating the premix pump 354 that controls an amount of the lubricant so that a mixture ratio of the lubricant with the fuel, which is determined by the fuel amount control map in FIG. 11, will be constant.

In this embodiment, if the engine speed is less than "x" and the engine load is less than "y", the ECU 116 will not operate the premix pump 354 and thus no lubricant is supplied to the vapor separator 224 because the fuel injection amount is not very large in this range. If, however, the engine speed exceeds "x" and the engine load exceeds "y", the ECU 116 will operate the premix pump 354 to supply a constant of fixed amount of the lubricant such as "A". The ECU 116 in this embodiment controls only two states, one is to supply no lubricant and the other is to supply constant amount lubricant "A". This method is, thus, quite simple.

Figure 13:
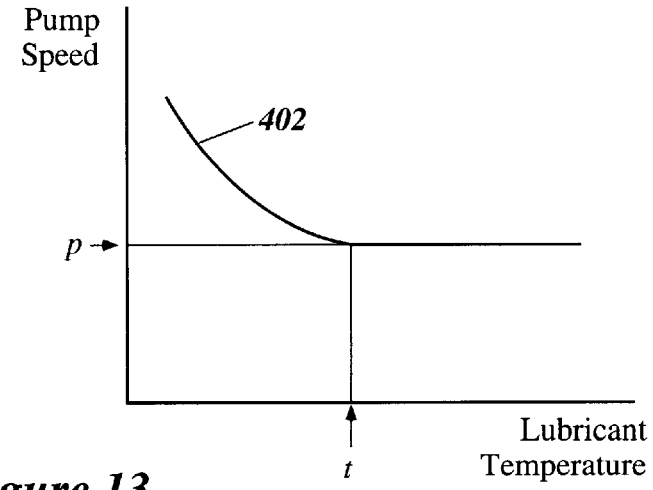
FIG. 13 is a graph showing a control map used to determine a pump speed of the lubricant pump versus a lubricant temperature in accordance with a second control method.

FIG. 13 illustrates a second control method. In this embodiment, the ECU 116 operates the premix pump 354 at a predetermined pump speed "p" so as to output a constant amount of the lubricant if the lubricant temperature exceeds "t". Otherwise, the ECU 116 increases a pump speed so as to be greater than "p" along the curve 402 in the graph. That is, the lower the lubricant temperature is, the greater the pump speed is. This is because a coefficient of viscosity of the lubricant is large when it is cold. Although a lubricant temperature sensor can sense the lubricant temperature, in the illustrated method, the ECU 116 uses the water temperature signal 330 because the lubricant temperature is generally proportioned to the water temperature.

With reference back to FIG. 5, in the illustrated embodiment, the engine 36 includes the fuel injectors 126 directly spraying fuel into the combustion chambers 160 as noted above. The injection nozzles 134 are hence exposed to the combustion chambers 160 in which air/fuel charges burn. Under the circumstances, the injection nozzles 134 are likely to have deposits (hydrocarbons) 404, particularly around the injection openings 146. The diameters of the openings 146, which are extremely precisely controlled, will be narrowed accordingly, and amounts of the fuel injected from the openings 146 must fluctuate. This is a serious problem with the fuel injection system 120.

In addition, marine engines are typically operated in a range of high load and high engine speed in comparison with automobile engines that are normally operated in a range of low load and low/medium engine speed. The engine operation in that range tends to develop insufficient vaporization of the fuel because of lack of injection time. The injected fuel, therefore, makes relatively large diameter mist that expedite production of the deposits.

Also, the engine 36 in this embodiment employs such a collective exhaust system as shown in FIG. 1. The collective exhaust system makes large differences in conditions of the respective cylinders. The engine 36 additionally practices the separate air/fuel ratio controls by the ECU. This type of engine particularly tends to have the foregoing problem with the deposits.

In order to resolve the problem, the user can add a cleaning agent that inhibits the deposits from being developed at the injection openings 146. The cleaning agent preferably includes surface-active substances such as aminoamid. A ratio of a cleaning agent amount relative to a lubricant amount is, for example, 5 to 25%.

The diameters of the openings 146, however, can be narrowed not only by the deposits 404 but also by rust. Whether adding the cleaning agent to the lubricant or not, therefore, the following third and fourth methods are effective as measures against narrowing of the injection openings.

Figure 14:
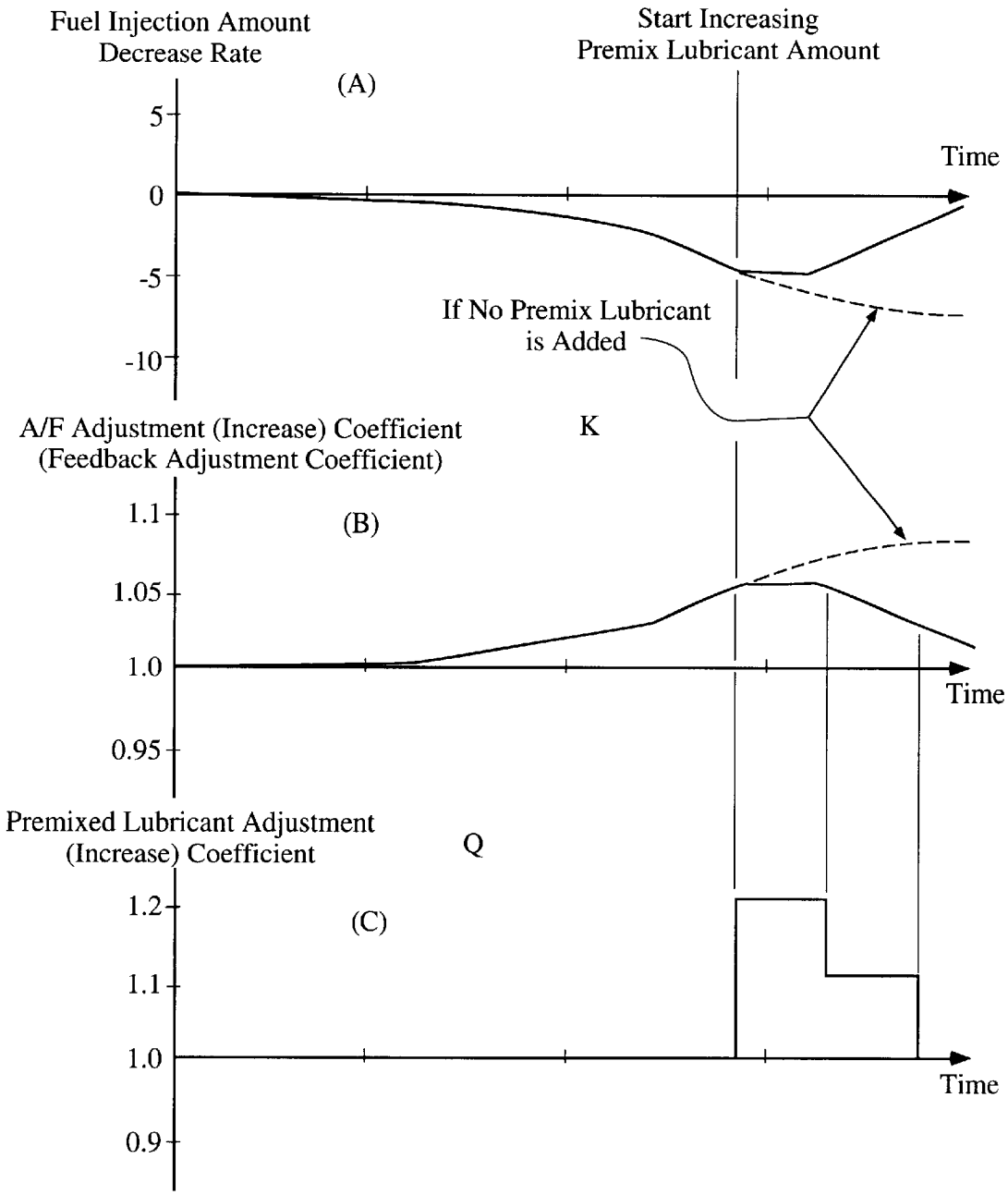
FIG. 14 is a graphical representation showing a control strategy in accordance with a third control method. The upper graph (A) illustrates an injection amount decrease rate versus time. The middle graph (B) illustrates an air/fuel ratio adjustment (increase) coefficient "K" versus time. The lower graph (C) illustrates a lubricant adjustment coefficient "Q" versus time.

FIG. 14 illustrates a control strategy of the third method. Generally, if the deposit 404 or rust is produced at the injection openings 146, a rate of the injection amount decreases as shown in the section (A). The ECU 116, therefore, is configured to increase the duration of the injection so as to compensate for the decrease of the injection amount. Actually, the ECU 116 increases an air/fuel adjustment (increase) coefficient or feedback adjustment coefficient "K" as shown in the section (B). This coefficient "K" is completely in inverse proportion to the injection amount decrease rate. As shown in the section (C), the ECU 116 starts controlling the premix pump 354 to operate with a lubricant adjustment (increase) coefficient "Q". The coefficient "Q" in this embodiment is selected as 1.2 when the air/fuel adjustment coefficient in the section (B) becomes greater than a first predetermined level 1.05. By this control, the air/fuel adjustment coefficient "K" will not increase and then goes down. The ECU 116 continuously watches if the air/fuel adjustment coefficient "K" becomes smaller than the first predetermined value 1.05 but grater than a second predetermined value 1.025. If this is affirmative, the ECU 116 controls the premix pump 354 to operate with another lubricant adjustment coefficient "Q", which is the value 1.1. Then, if the air/fuel adjustment coefficient "K" becomes smaller than the second predetermined value 1.025, the ECU 116 no longer has the premix pump 354 increase the lubricant to the fuel injection system 120.

The ECU 116 stores this data as control maps. Incidentally, The sections (A) and (B) of FIG. 14 also show that both the actual lines continue to extend along the dotted lines if no lubricant is supplied to the fuel injection system 120.

Figure 15:
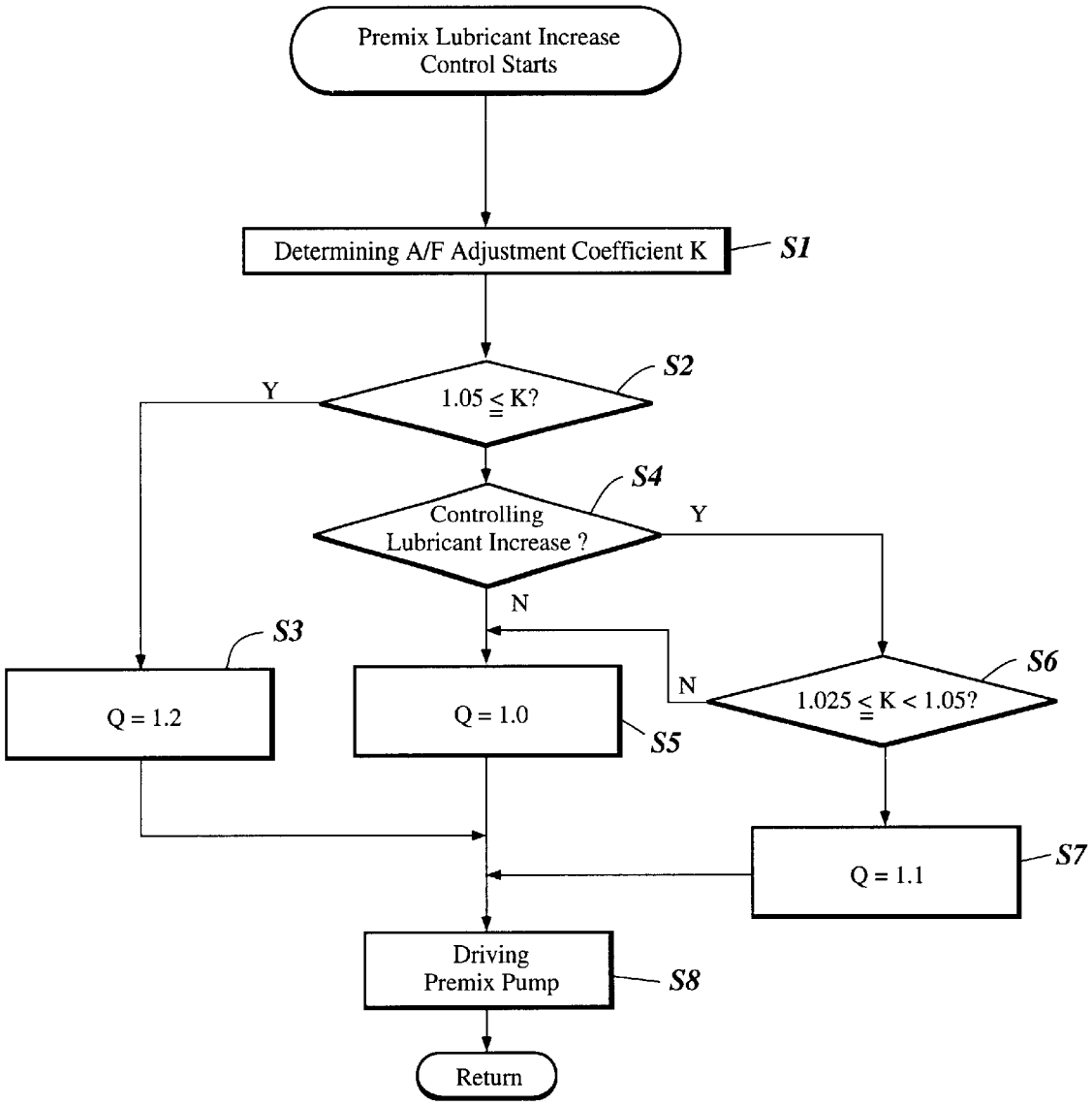
FIG. 15 is a flowchart showing a control routine based upon the control strategy represented by the graphs of FIG. 14.

FIG. 15 illustrates a control routine practiced by the ECU 116 to realize the third method. The program starts and proceeds to the step S1 to determine the air/fuel adjustment coefficient "K".

The program then goes to the step S2 to determine if the air/fuel adjustment coefficient "K" is greater than the value 1.05. If this is positive, the program goes to the step S3. If, however, it is negative, the program goes to the step S4.

At the step S3, the program determines the lubricant adjustment coefficient "Q" as the value 1.2. After the step S3, the program goes to the step S8.

At the step S4, the program determines whether the ECU 116 is in an increase control of the premix pump 354. At the first time, this is negative. Thus, the program goes to the step S5. If, however, it is positive in a second or later circulation, the program goes to the step S6.

At the step S5, the program determines the lubricant adjustment coefficient "Q" as the value 1.0. After the step S5, the program goes to the step S8.

It should be noted that the coefficient "Q" is the value 1.0 means that the premix pump 354 operates to supply a standard amount of the lubricant, i.e., neither increased nor decreased amount. Alternatively, however, another control is available such that no lubricant will be supplied if the program goes to the step S5.

At the step S6, the program determines if the air/fuel adjustment coefficient "K" is smaller than the value 1.05 but greater than the value 1.025. If this is positive, the program goes to the step S7. If, however, it is negative, the program goes to the step S5.

At the step S7, the program determines the lubricant adjustment coefficient "Q" as the value 1.1. After the step S7, the program goes to the step S8.

At the step S8, the program operates the premix lubricant pump 354 so that the pump 354 supplies the amount of lubricant that has been determined.

After practicing this control routine, the program again returns to the step S1 and repeats circulation of the routine until the end of the engine operation.

Figure 16:
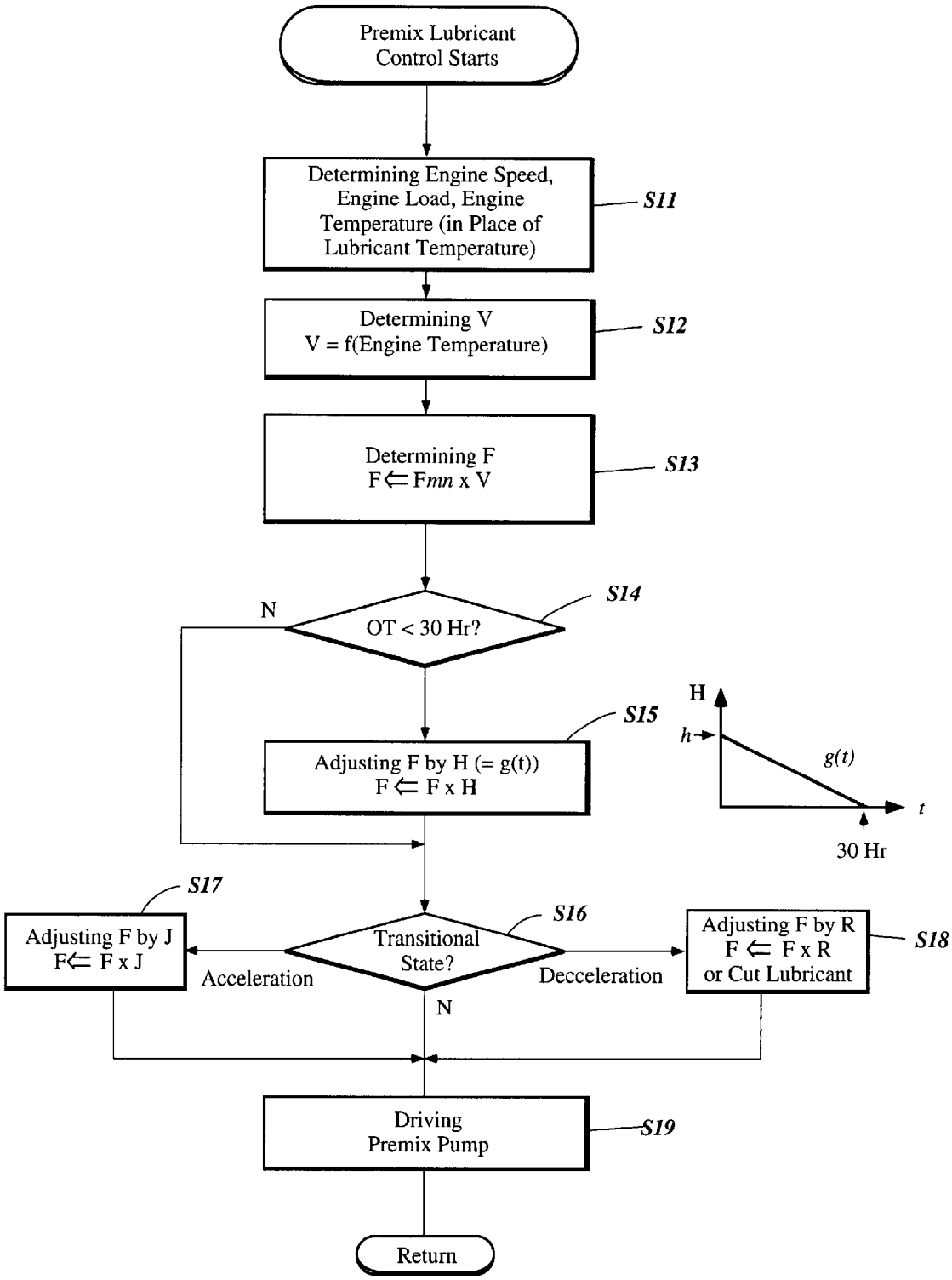
FIG. 16 is a flowchart showing another control routine to practice a control strategy in accordance with a fourth control method.

FIG. 16 illustrates another control routine practiced by the ECU 116 to realize the fourth control method. The program starts and proceeds to the step S11. The ECU 116 determines an engine speed, engine load and lubricant temperature. The engine speed is determined by the signal 316 from the crankshaft angle position sensor 314. The engine load is determined by the signal 320 from the throttle position sensor 318. The lubricant temperature, in turn, is indirectly determined by the signal 330 from the water temperature sensor 328.

Next, the program goes to the step S12 and determines an adjustment coefficient of viscosity of the lubricant. This adjustment coefficient is determined by a graph shown in FIG. 17. The viscosity "V" at the vertical axis is generally in inverse proportion to the lubricant temperature "T" at the horizontal axis. For example, if the lubricant temperature "T" is "$T_1$", the viscosity "V" is "$V_1$".

The control routine then goes to the step S13 and first determines a fundamental amount "$F_{mn}$" of the lubricant based upon a temperature of the injection nozzle 134, i.e., the tip portion of the injector 126. Because the deposits 404 that can close the injection openings 146 are most likely to be produced in a range of the temperature 100° C. to 200° C. As shown in FIG. 18, in an exemplifying mode, generally, the temperature of this portion is given if both the engine speed and the engine load are determined. For example, if the engine speed is "s" and the engine load is "d", then the temperature will be 130° C. Because of this, the fundamental amount "$F_{mn}$" can be previously stored in a control map as shown in FIG. 19. If, therefore, the engine speed is "s" and the engine load is "d", then the fundamental amount "$F_{mn}$" will be determined as the value 8. Then, the program determines an adjusted amount "F" that is given in multiplying the coefficient "V", which has been obtained at the step S12, to the fundamental amount "$F_{mn}$". That is, the adjusted amount F is given by the following formula:

$$F=F_{mn}\times V$$

Then, the program goes to the step S14 and determines whether the overall operation time "OT" of the engine 36 exceeds thirty hours or not. For this purpose, the ECU 116 has a timer that measures the operation time of the engine 36. Otherwise, the ECU 116 can have a counter that counts the number of times of the signal 316 from the crankshaft angle position sensor 314. If the answer is positive, the program goes to the step S15. If it is negative, the program goes to the step S16 bypassing the step S15.

At the step S15, the program determines a time adjustment coefficient "H" based upon the graph shown in the right-hand side of the step S15 in FIG. 16. The time adjustment coefficient "H" decreases in inverse proportion to the lapse of time "t". That is, the time adjustment coefficient "H" starts at the value "h" and then decreases to zero in thirty hours. The adjusted amount "F" is again adjusted with this value "H". That is, the adjusted amount "F" is given by the following formula:

$$F=F\times H$$

This is because a new engine requires a large quantity of lubricant. After the step S15, the program goes to the step S16.

At the step S16, the program determines if the engine 36 is in an acceleration period, deceleration period or no such transitional periods. If the program determines that it is in an acceleration period, then it goes to the step S17. If the program determines that it is in a deceleration period, then it goes to the step S18. If it determines that neither acceleration nor deceleration is made, then it goes to the step S19. The ECU 116 can recognize the acceleration or deceleration condition by the signal 320 from the throttle position sensor 318 that shows an open or close state of the throttle valve 90 and its change rate.

At the step S17, the program further adjusts the adjusted amount "F" with an acceleration adjusting coefficient "J" to increase the amount "F". That is, the adjusted amount "F" is given by the following formula:

$$F=F\times J$$

Meanwhile, at the step S18, the program adjusts the adjusted amount "F" with a deceleration adjusting coefficient "R". Alternatively, the amount "F" can be zero to completely cut the lubricant. That is, the adjusted amount F is given by the following formula:

$$F=F\times R$$

or $$F=0$$

After either the step 17 or step 18, the program goes to the step S19.

At the step 19, the program operates the premix lubricant pump 354 so that the pump 354 supplies the amount of lubricant that has been determined.

After practicing this control routine, the program again returns to the step S11 and repeats circulation of the routine until the end of the engine operation.

The lubricant amount depends on the pump speed of the premix pump 354. If the pump 354 is the plunger-type, the pump speed changes with the change of the motor speed, and this motor speed is changeable by controlling a current or voltage supplied to the motor.

Figure 20:
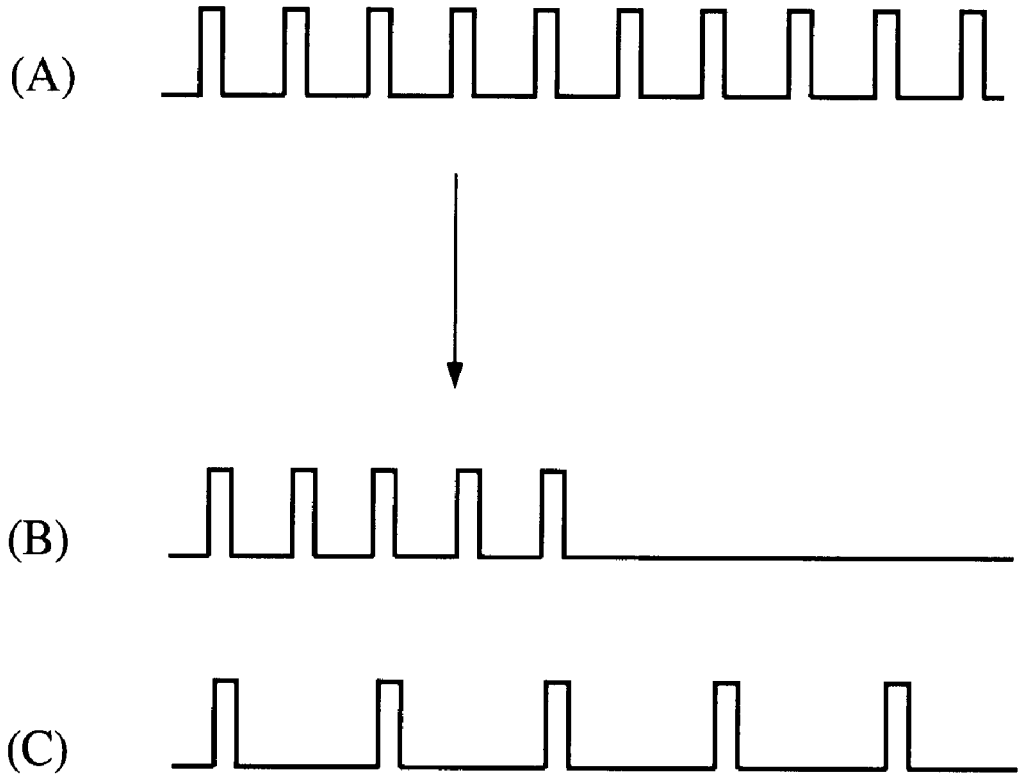
FIG. 20 are exemplifying timing diagrams for controlling an electromagnetic-type lubricant pump.

If the pump 354 is the electromagnetic-type pump, the pump speed reduces with a partial operation or with the change of its duty ratio. For example, FIGS. 20(A), (B) and (C) illustrates this control. FIG. 20(A) shows a line of pulses under a certain duty ratio. If the electromagnetic pump must reduce the pump speed, a several pulses are given and the rest of the pulses are omitted as shown in FIG. 20(B) or the duty ratio is reduced as shown in FIG. 20 (C).

As a fifth method, the ECU 116 can control the premix pump 354 using the signal 218 from the water-sensing system 180. That is, the ECU 116 allows the premix pump 354 to supply a predetermined amount of the lubricant when it receives the signal 218. The ECU 116, in this regard, can start supplying the lubricant, or increase the lubricant amount in the situation that the premix pump 354 has already supplied the lubricant.

As described above, in the illustrated embodiments, part of the lubricant is mixed to the fuel under control of the ECU. The fuel injection system thus can inhibit, by introducing lubricant into the fuel, its components from being rusted in the event that water, particularly salt water, is mixed into the fuel. In addition, the lubricant amount supplied to the fuel injection system is always kept in a proper and extremely small range. No lubricant is, therefore, wasted for the purpose, and neither white smoke nor plug foul will occur. Of course, for this affect, the amount of lubricant introduced into the fuel is much less than the amount of lubricant delivered to the engine by the lubrication pump 98.

The present invention can be practiced not only with a direct injected engine but also with an indirect injected engine such that the fuel is injected into the air induction system.

Although the present invention has particular applicability in connection with an outboard motor, and therefore has been described in this context, certain aspects of the present invention can be used with other marine drive units as well (e.g., a stem drive unit).

Of course, the foregoing description is that of a preferred embodiment of the present invention, and various changes and modifications may be made without departing from the spirit and scope of the invention, as defined by the appended claims.

What is claimed is:

1. A fuel injected, internal combustion engine for a marine propulsion device comprising a combustion chamber, a fuel delivery system arranged to deliver fuel for combustion in the combustion chamber, the fuel delivery system including a fuel injector spraying the fuel, a lubricant delivery system arranged to deliver lubricant to at least one portion of the engine that needs lubrication, the lubricant delivery system including a first lubrication pump, an intermediate lubricant supply system operating between the lubricant delivery system and the fuel delivery system to supply an amount of the lubricant to the fuel delivery system from the lubricant delivery system so as to mix the amount of the lubricant with the fuel, the intermediate lubricant supply system including a second lubrication pump, and a control device arranged to control the amount of the lubricant supplied to the fuel delivery system through the intermediate lubricant supply system.

2. The fuel injected, internal combustion engine as set forth in claim 1 additionally comprising at least one sensor arranged to sense an operational condition of the engine, wherein the control device further controls an amount of the fuel in response to an output of the sensor, and the control device controls the amount of the lubricant in proportion to the amount of the fuel.

3. The fuel injected, internal combustion engine as set forth in claim 2, wherein the operational condition of the engine includes at least one of engine speed and engine load.

4. The fuel injected, internal combustion engine as set forth in claim 2, wherein the control device is configured to increase the amount of the lubricant when the amount of the fuel increases.

5. The fuel injected, internal combustion engine as set forth in claim 4, wherein the control device is configured to start increasing the amount of the lubricant when the amount of the fuel is greater than a predetermined level.

6. The fuel injected, internal combustion engine as set forth in claim 2, wherein the proportion is constant.

7. The fuel injected, internal combustion engine as set forth in claim 1 additionally comprising a sensor arranged to sense a lubricant temperature related condition, wherein the control device increases the amount of the lubricant when an output of the sensor substantially indicates that a temperature of the lubricant is lower than a predetermined level.

8. The fuel injected, internal combustion control engine as set forth in claim 7, wherein the control device is configured to increase the amount of the lubricant inversely to the lubricant temperature.

9. The fuel injected, internal combustion engine as set forth in claim 7, wherein the sensor senses an engine temperature that is proportional to the lubricant temperature.

10. The fuel injected, internal combustion engine as set forth in claim 1, wherein the fuel delivery system includes a fuel reservoir, and the intermediate lubricant supply system is connected to the fuel reservoir.

11. The fuel injected, internal combustion engine as set forth in claim 10, wherein the fuel delivery system includes a delivery passage through which the fuel is delivered to the fuel injector from the fuel reservoir, and at least one return passage through which part of the fuel returns to the fuel reservoir, and the intermediate lubricant supply system is connected to the return passage.

12. The fuel injected, internal combustion engine as set forth in claim 1, wherein the second lubrication pump is affixed to the engine via an elastic member.

13. The fuel injected, internal combustion engine as set forth in claim 12, wherein the fuel delivery system includes a fuel reservoir affixed to the engine via the elastic member, and the second lubrication pump is affixed to the engine through the fuel reservoir.

14. The fuel injected, internal combustion engine as set forth in claim 12, wherein the fuel delivery system includes a fuel filter affixed to the engine via the elastic member, and the second lubrication pump is affixed to the engine through the fuel filter.

15. The fuel injected, internal combustion engine as set forth in claim 1 additionally comprising an output shaft, wherein the second lubrication pump includes a plunger, and an axis of the plunger is disposed generally in parallel to an axis of the output shaft.

16. The fuel injected, internal combustion engine as set forth in claim 1, wherein the fuel delivery system includes a fuel pump, and the fuel pump includes an electrical element immersed in the fuel.

17. The fuel injected, internal combustion engine as set forth in claim 16, wherein the fuel pump is disposed in a fuel reservoir containing the fuel.

18. The fuel injected, internal combustion engine as set forth in claim 16, wherein the fuel pump is an electrical pump, and generally an entire body of the electrical pump is immersed in the fuel.

19. The fuel injected internal combustion engine as set forth in claim 1, wherein the fuel injector is arranged to spray the fuel directly into the combustion chamber.

20. The fuel injected, internal combustion engine as set forth in claim 19, wherein the lubricant is mixed with a cleaning agent.

21. The fuel injected, internal combustion engine as set forth in claim 20, wherein the cleaning agent includes a surface-active substance.

22. The fuel injected, internal combustion engine as set forth in claim 19, wherein the fuel injector includes a nozzle exposed into the combustion chamber, and the control device is configured to control the amount of the lubricant based upon a control map reflecting a temperature of the nozzle.

23. The fuel injected, internal combustion engine as set forth in claim 22 additionally comprising at least one sensor arranged to sense operational condition of the engine, wherein the control device is configured to determine the temperature in response to an output of the sensor.

24. The fuel injected, internal combustion engine as set forth in claim 1 additionally comprising a sensor arranged to sense an engine load, wherein the control device is configured to calculate a change ratio of the engine load based upon a signal from the sensor, and to alter the amount of lubricant when the change ratio varies.

25. The fuel injected, internal combustion engine as set forth in claim 1, wherein the engine operates on a two-stroke combustion principle.

26. The fuel injected, internal combustion engine as set forth in claim 1, wherein the fuel delivery system includes a sensor arranged to sense water in the fuel, and the control device is configured to allow the intermediate lubricant supply system to supply a predetermined amount of the lubricant at least when an output of the sensor indicates that the water is present.

27. The fuel injected, internal combustion engine as set forth in claim 1, wherein the control device is configured to measure overall engine run time, and to increase the amount of lubricant while the measured time is in a predetermined range.

28. A fuel injected, internal combustion engine for a marine propulsion device comprising a combustion chamber, a fuel delivery system arranged to deliver fuel for combustion in the combustion chamber, the fuel delivery system including a fuel injector spraying the fuel, a lubricant delivery system arranged to deliver lubricant to at least one portion of the engine that needs lubrication, the fuel delivery system including a sensor arranged to sense water in the fuel, an intermediate lubricant supply system operating between the lubricant delivery system and the fuel delivery system to supply an amount of lubricant to the fuel delivery system from the lubricant delivery system so as to mix the amount of the lubricant with the fuel, and a control device arranged to control the amount of the lubricant supplied to the fuel delivery system through the intermediate lubricant supply system, the control device being configured to allow the intermediate lubricant supply system to supply a predetermined amount of the lubricant at least when an output of the sensor indicates that the water is present.

29. A fuel injected, internal combustion engine for a marine propulsion device comprising a combustion chamber, a fuel delivery system arranged to deliver fuel for combustion in the combustion chamber, the fuel delivery system including a fuel injector spraying the fuel, a lubricant delivery system arranged to deliver lubricant to at least one portion of the engine that needs lubrication, an intermediate lubricant supply system operating between the lubricant delivery system and the fuel delivery system to supply an amount of lubricant to the fuel delivery system from the lubricant delivery system so as to mix the amount of the lubricant with the fuel, and a control device arranged to control the amount of the lubricant supplied to the fuel delivery system through the intermediate lubricant supply system, the control device being configured to measure overall engine run time, and to increase the amount of the lubricant while the measured time is in a predetermined range.

30. A method of operating a marine engine having a combustion chamber, a fuel delivery system, a lubricant delivery system, and a control device, the fuel delivery system including a fuel injector, the lubricant delivery system including first and second lubricant pumps, the method comprising delivering fuel to the fuel injector through the fuel delivery system, spraying fuel for combustion in the combustion chamber by the fuel injector, delivering lubricant to at least one portion of the engine that needs lubrication through the lubricant delivery system by the first lubricant pump, supplying an amount of lubricant to the fuel delivery system from the lubricant delivery system by the second lubricant pump so as to mix the supplied amount of the lubricant with the fuel, and controlling the amount of the lubricant in accordance with at least one operating parameter that is indicative of engine running conditions.

31. The method as set forth in claim 30 additionally comprising determining an amount of the fuel in response to an output of a sensor, which senses the operating parameter, and determining an amount of the lubricant in proportion to the amount of the fuel sprayed for combustion in the combustion chamber.

32. The method as set forth in claim 31 additionally comprising determining whether the amount of the fuel is greater than a predetermined level, and increasing the amount of lubricant when the amount of the fuel is greater than the predetermined level.

33. The method as set forth in claim 30 additionally comprising determining whether a temperature of the lubricant is lower than a predetermined level, and increasing the amount of lubricant when the temperature is lower than the predetermined level.

34. The method as set forth in claim 30 additionally comprising mixing a cleaning agent with the lubricant.

35. The method as set forth in claim 30 additionally comprising calculating a change ratio of the engine load, and altering the amount of lubricant when the change ratio varies.

36. The method as set forth in claim 30, wherein the operating parameter includes at least one of engine speed and engine load.

37. The method as set forth in claim 30 additionally comprising determining whether water exists in the fuel based upon a signal from a sensor, which senses water, and supplying a predetermined amount of lubricant to the fuel delivery system when the water is present.

38. The method as set forth in claim 30 additionally comprising increasing the amount of lubricant while the overall running time of the engine is in a predetermined range.

39. A method of operating a marine engine having a combustion chamber, a fuel delivery system, a lubricant delivery system, a sensor, and a control device, the fuel delivery system including a fuel injector, the method comprising delivering fuel to the fuel injector through the fuel delivery system, spraying fuel for combustion in the combustion chamber by the fuel injector, delivering lubricant to at least one portion of the engine that needs lubrication through the lubricant delivery system, supplying an amount of lubricant to the fuel delivery system so as to mix the supplied amount of the lubricant with the fuel, controlling the amount of the lubricant in accordance with at least one operating parameter that is indicative of engine running conditions, determining whether water exists in the fuel based upon a signal from the sensor, and supplying a predetermined amount of the lubricant to the fuel delivery system when the water is present.

40. A method of operating a marine engine having a combustion chamber, a fuel delivery system, a lubricant delivery system, a sensor, and a control device, the fuel delivery system including a fuel injector, the method comprising delivering fuel to the fuel injector through the fuel delivery system, spraying fuel for combustion in the combustion chamber by the fuel injector, delivering lubricant to at least one portion of the engine that needs lubrication through the lubricant delivery system, supplying an amount of lubricant to the fuel delivery system so as to mix the supplied amount of the lubricant with the fuel, controlling the amount of the lubricant in accordance with at least one operating parameter that is indicative of engine running conditions, and increasing the amount of the lubricant while the overall running time of the engine is in a predetermined range.

41. A fuel injected, internal combustion engine for a marine propulsion device comprising a combustion chamber, a fuel injector arranged to spray fuel for combustion in the combustion chamber, a fuel delivery system arranged to deliver the fuel to the fuel injector, the fuel delivery system including a fuel reservoir coupled with the fuel injector through a fuel delivery passage and a fuel return passage, a lubricant delivery system arranged to deliver lubricant to at least one portion of the engine that needs lubrication with a first lubricant pump, an intermediate lubricant supply system comprising a second lubricant pump and operating between the lubricant delivery system and the fuel delivery system to supply an amount of lubricant to the fuel delivery system from the lubricant delivery system to mix the amount of the lubricant with the fuel, the intermediate lubricant supply system being connected with the fuel return passage, and a control device arranged to control the amount of the lubricant supplied to the fuel delivery system through the intermediate lubricant supply system.

42. A fuel injected, internal combustion engine for a marine propulsion device comprising a combustion chamber, a fuel injector arranged to spray fuel for combustion in the combustion chamber, a fuel delivery system arranged to deliver the fuel to the fuel injector, the fuel delivery system including a fuel pump pressurizing the fuel to the fuel injector, a lubricant delivery system arranged to deliver lubricant to at least one portion of the engine that needs lubrication with a first lubricant pump, an intermediate lubricant supply system comprising a second lubricant pump and operating between the lubricant delivery system and the fuel delivery system to supply an amount of lubricant to the fuel delivery system from the lubricant delivery system to mix the amount of the lubricant with the fuel, the intermediate lubricant supply system being connected to the fuel delivery system upstream of the fuel pump, and a control device arranged to control the amount of the lubricant supplied to the fuel delivery system through the intermediate lubricant supply system.

43. A fuel injection system for a marine engine comprising a fuel injector arranged to spray fuel for combustion in a combustion chamber of the engine, a fuel delivery mechanism arranged to deliver the fuel to the fuel injector, the fuel delivery mechanism including at least two fuel reservoirs coupled in series with one another, a primary lubricant supply mechanism arranged to supply lubricant to an engine component, a secondary lubricant supply mechanism arranged to supply lubricant from the primary lubricant supply mechanism to the fuel delivery mechanism to mix the lubricant with the fuel, the secondary lubricant supply mechanism being connected to the fuel delivery mechanism at a location between the fuel reservoirs, and a control device arranged to control an amount of the lubricant supplied to the fuel delivery mechanism from the secondary lubricant supply mechanism.

44. The fuel injection system as set forth in claim 43, wherein one of the fuel reservoirs disposed downstream includes a vapor separator.

45. A fuel injection system for a marine engine comprising a fuel injector arranged to spray fuel for combustion in a combustion chamber of the engine, a fuel delivery mechanism arranged to deliver the fuel to the fuel injector, the fuel delivery mechanism including at least two fuel reservoirs coupled in series with one another, a fresh lubricant supply mechanism arranged to supply fresh lubricant to the fuel delivery mechanism from a fresh oil tank to mix the fresh lubricant with the fuel, the fresh lubricant supply mechanism being connected to a location between the fuel reservoirs, and a control device arranged to control an amount of the fresh lubricant supplied to the fuel delivery mechanism from the fresh lubricant tank, wherein the fresh lubricant supply mechanism further comprises a fresh lubricant subtank that is fluidly connected with the fresh lubricant tank, a conduit that connects the fresh lubricant tank to the fuel delivery mechanism, a fresh premix lubrication pump that is positioned along the conduit, the fresh premix lubrication pump being positioned between the fuel delivery mechanism and the fresh lubricant tank and the fresh lubricant tank being interposed between the fresh lubricant subtank and the conduit.

46. The fuel injection internal combustion engine of claim 45, wherein the conduit delivers fresh oil from the fresh lubricant premix lubrication pump directly to a pressure relief fuel line leading to a fuel vapor separator.

47. The fuel injection internal combustion engine of claim 45, wherein the conduit delivers fresh oil from the fresh lubricant premix lubrication pump directly to a fuel line positioned between a fuel check valve and a fuel conduit leading directly to a fuel vapor separator.

48. The fuel injection internal combustion engine of claim 45, whereby the fresh lubricant sub tank is positioned separate from the marine engine.

49. The fuel injection internal combustion engine of claim 45, wherein the control device is arranged to control a specific amount of the fresh lubricant supplied to the fuel delivery mechanism from the fresh lubricant tank in response to a sensed engine operating condition.

50. The fuel injection internal combustion engine of claim 49, wherein the specific amount of fresh lubricant is selected within a range defined between about 1/200 and about 1/2000 parts fresh lubricant to parts fuel.

51. The fuel injection internal combustion engine of claim 49, wherein the specific amount of fresh lubricant is about 1/2000 parts fresh lubricant to parts fuel.

52. The fuel injection internal combustion engine of claim 49, wherein the allowable amount of fresh lubricant to fuel ratio is a fully adjustable amount between a minimum ratio of 1:200 and a maximum ratio of 1:2000.

53. A fuel injected marine engine comprising a combustion chamber, a fuel supply system for supplying fuel to said combustion chamber, said fuel supply system comprising a fuel tank, a vapor separator fluidly connected to said fuel tank, a first fuel pump adapted to supply fuel from said fuel tank to said vapor separator, a fuel injector connected to said vapor separator by a fuel supply line and a fuel return line, a second fuel pump adapted to supply fuel to said fuel injector from said vapor separator;

a lubricant supply system for supplying lubricant to at least one engine component, said lubricant supply system comprising a lubricant tank, a first lubricant pump adapted to draw lubricant from said lubricant tank and supply lubricant to said at least one engine component;

a conduit communicating with said fuel supply system and said lubricant supply system, said conduit extending between said vapor separator and a location upstream of said first lubricant pump.

54. The engine of claim 53 further comprising a lubricant filter positioned along said conduit.

55. The engine of claim 53 further comprising a check valve positioned along said conduit.

56. The engine of claim 55, wherein said portion of said conduit disposed between said check valve and said vapor separator is transparent.

57. The engine of claim 53, further comprising a second lubricant pump positioned along said conduit.

58. The engine of claim 53, wherein said engine further comprises a crankcase and said vapor separator is mounted to said crankcase with elastic members.

59. The engine of claim 58 further comprising a second lubricant pump positioned along said conduit and mounted to said vapor separator.

60. The engine of claim 53 further comprising a control unit and a second lubricant pump positioned along said conduit, said control unit controlling said second lubricant pump.

61. The engine of claim 60, wherein said second lubricant pump supplies lubricant to said fuel system at a substantially constant lubricant/fuel ratio selected between about 1/250 and about 1/2000.

62. The engine of claim 61, wherein said lubricant/fuel ratio is approximately 1/2000.

63. The engine of claim 60, wherein said second lubricant pump is not operated at engine speeds below a preset engine speed and engine loads below a preset engine load.

64. The engine of claim 60, wherein said second lubricant pump is operated at a generally constant throughput if a lubricant temperature exceeds a preset temperature.

65. The engine of claim 64, wherein said second lubricant pump is operated to increase throughput as lubricant temperature decreases if said lubricant temperature is below said preset temperature.

66. The engine of claim 53 further comprising a generally vertically extending crankshaft and a second lubricant pump positioned along said conduit, said second lubricant pump comprising a plunger that is disposed substantially parallel to said crankshaft.

67. The engine of claim 53, wherein said conduit communicates with said fuel return line such that said conduit is connected to said vapor separator by said fuel return line.

* * * * *